US009679444B2

(12) United States Patent
Ryan

(10) Patent No.: US 9,679,444 B2
(45) Date of Patent: Jun. 13, 2017

(54) ELECTRONIC GAMING DEVICE WITH REEL EXPOSING FUNCTIONALITY

(71) Applicant: Cadillac Jack, Inc., Duluth, GA (US)

(72) Inventor: Timothy Curtis Ryan, Duluth, GA (US)

(73) Assignee: Cadillac Jack, Inc., Duluth, GA (US)

( * ) Notice: Subject to any disclaimer, the term of this patent is extended or adjusted under 35 U.S.C. 154(b) by 661 days.

(21) Appl. No.: 14/101,993

(22) Filed: Dec. 10, 2013

(65) Prior Publication Data

US 2015/0161853 A1 Jun. 11, 2015

(51) Int. Cl.
*G07F 17/34* (2006.01)
*G07F 17/32* (2006.01)

(52) U.S. Cl.
CPC ..... *G07F 17/34* (2013.01); *G07F 17/3244* (2013.01)

(58) Field of Classification Search
CPC ..... G07F 17/34; G07F 17/32; G07F 17/326; G07F 17/3262; G07F 17/3265; G07F 17/3269; G07F 17/3244
See application file for complete search history.

(56) References Cited

U.S. PATENT DOCUMENTS 5,890,962 A 4/1999 Takemoto
6,270,412 B1 * 8/2001 Crawford ..... G07F 17/3265 273/143 R
6,544,120 B2 * 4/2003 Ainsworth ..... G07F 17/34 273/138.2
7,601,062 B2 10/2009 Cole et al.
7,654,895 B2 2/2010 Pacey
8,246,442 B1 8/2012 Barrie
8,512,124 B2 8/2013 Bramble et al.
8,602,868 B2 12/2013 Johnson et al.
8,795,059 B2 8/2014 Aoki et al.
9,047,740 B2 * 6/2015 Owen ..... G07F 17/34
2003/0064782 A1 * 4/2003 Beaulieu ..... G07F 17/32 463/20
2004/0029636 A1 * 2/2004 Wells ..... G07F 17/3211 463/32
2005/0159208 A1 * 7/2005 Pacey ..... G07F 17/34 463/20
2006/0247002 A1 11/2006 Yoshimi et al.
2007/0060255 A1 3/2007 Baerlocher et al.
2008/0108408 A1 5/2008 Wolf
2008/0113696 A1 * 5/2008 Owen ..... G07F 17/3267 463/1
2008/0113755 A1 * 5/2008 Rasmussen ..... G07F 17/3211 463/20
2009/0075722 A1 * 3/2009 Louie ..... G07F 17/32 463/20

(Continued)

FOREIGN PATENT DOCUMENTS

AU 2007202816 2/2008

*Primary Examiner* — Jasson Yoo
(74) *Attorney, Agent, or Firm* — Weide & Miller, Ltd.

(57) ABSTRACT

Examples disclosed herein relate to an electronic gaming device including a memory, a processor, and a plurality of reels. The memory may include one or more reel exposing feature structures. The processor may generate one or more symbols to be located in the one or more areas. The processor may display one or more symbols in a base game area before a start of game play. The processor may display one or more revealed symbols in one or more revealed areas after the start of game play is initiated.

20 Claims, 33 Drawing Sheets

(56) References Cited

U.S. PATENT DOCUMENTS

| | | | | |
|---|---|---|---|---|
| 2009/0156287 | A1 | 6/2009 | Baumgartner | |
| 2010/0113133 | A1 | 5/2010 | Leupp | |
| 2010/0203948 | A1 | 8/2010 | Falciglia, Sr. | |
| 2010/0331072 | A1* | 12/2010 | Wiryadi | G07F 17/34 463/20 |
| 2011/0244943 | A1 | 10/2011 | Milford et al. | |
| 2013/0337884 | A1* | 12/2013 | Condron | G07F 17/3211 463/20 |

* cited by examiner

ELECTRONIC GAMING DEVICE WITH REEL EXPOSING FUNCTIONALITY

FIELD

The subject matter disclosed herein relates to an electronic gaming device. More specifically, the disclosure relates to providing one or more reel exposing functionalities on a gaming device.

INFORMATION

The gaming industry has numerous casinos located both worldwide and in the United States. A client of a casino or other gaming entity can gamble via various games of chance. For example, craps, roulette, baccarat, blackjack, and electronic games (e.g., a slot machine) where a person may gamble on an outcome.

Paylines of an electronic gaming device (e.g., a slot machine) are utilized to determine when predetermined winning symbol combinations are aligned in a predetermined pattern to form a winning combination. A winning event occurs when the player successfully matches the predetermined winning symbols in one of the predetermined patterns.

A player's entertainment while playing one or more games may be enhanced by utilizing one or more reel exposing functionalities on the gaming device. By increasing the player's entertainment level, the player's enjoyment of the game may be enhanced, which may increase a player's game playing period.

BRIEF DESCRIPTION OF THE FIGURES

Non-limiting and non-exhaustive examples will be described with reference to the following figures, wherein like reference numerals refer to like parts throughout the various figures.

DETAILED DESCRIPTION

Figure 1:
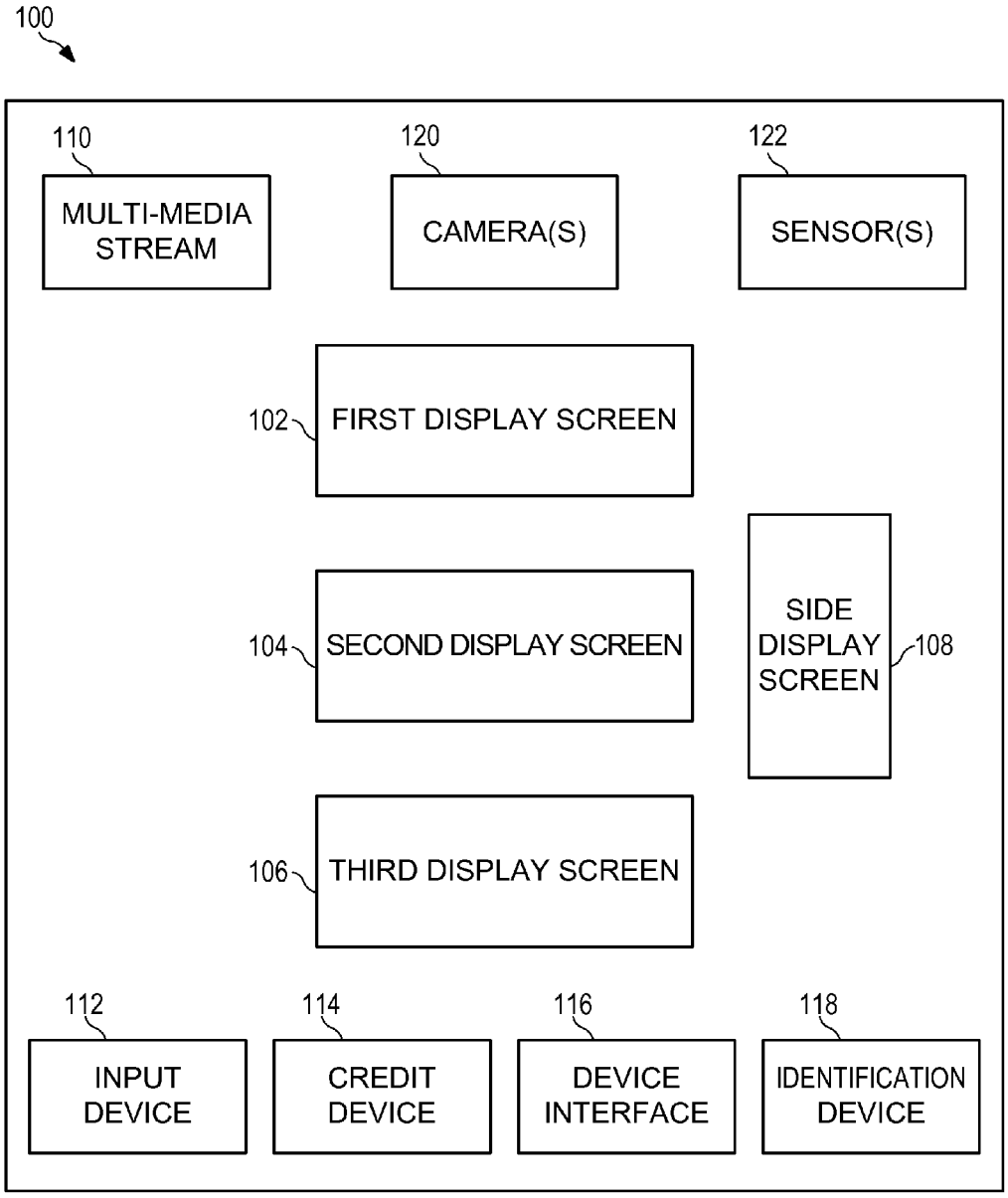
FIG. 1 is an illustration of the electronic gaming device, according to one embodiment.

FIG. 1 is an illustration of an electronic gaming device 100. Electronic gaming device 100 may include a multi-media stream 110, a first display screen 102, a second display screen 104, a third display screen 106, a side display screen 108, an input device 112, a credit device 114, a device interface 116, and an identification device 118. Electronic gaming device 100 may display one, two, a few, or a plurality of multi-media streams 110, which may be obtained from one or more gaming tables, one or more electronic gaming devices, a central server, a video server, a music server, an advertising server, another data source, and/or any combination thereof.

Multi-media streams may be obtained for an entertainment event, a wagering event, a promotional event, a promotional offering, an advertisement, a sporting event, any other event, and/or any combination thereof. For example, the entertainment event may be a concert, a show, a television program, a movie, an Internet event, and/or any combination thereof. In another example, the wagering event may be a poker tournament, a horse race, a car race, and/or any combination thereof. The advertisement may be an advertisement for a casino, a restaurant, a shop, any other entity, and/or any combination thereof. The sporting event may be a football game, a baseball game, a hockey game, a basketball game, any other sporting event, and/or any combination thereof. These multi-media streams may be utilized in combination with the gaming table video streams.

Input device 112 may be mechanical buttons, electronic buttons, mechanical switches, electronic switches, optical switches, a slot pull handle, a keyboard, a keypad, a touch screen, a gesture screen, a joystick, a pointing device (e.g., a mouse), a virtual (on-screen) keyboard, a virtual (on-screen) keypad, biometric sensor, or any combination thereof. Input device 112 may be utilized to select one or more reel exposing gaming options, to make a wager, to control any object, to select one or more pattern gaming options, to obtain data relating to historical payouts, to select a row and/or column to move, to select a row area to move, to select a column area to move, to select a symbol (or image) to move, to modify electronic gaming device 100 (e.g., change sound level, configuration, font, language, etc.), to select a movie or song, to select live multi-media streams, to request services (e.g., drinks, slot attendant, manager, etc.), to select two-dimensional ("2D") game play, to select three-dimensional ("3D") game play, to select both two-dimensional and three-dimensional game play, to change the orientation of games in a three-dimensional space, to move a symbol (e.g., wild, multiplier, etc.), and/or any combination thereof. These selections may occur via any other input device (e.g., a touch screen, voice commands, etc.). Input device 112 may be any control panel.

Credit device 114 may be utilized to collect monies and distribute monies (e.g., cash, vouchers, etc.). Credit device 114 may interface with a mobile device to electronically transmit money and/or credits. Credit device 114 may interface with a player's card to exchange player points.

Device interface 116 may be utilized to interface electronic gaming device 100 to a bonus game device, a local area progressive controller, a wide area progressive controller, a progressive sign controller, a peripheral display device, signage, a promotional device, network components, a local network, a wide area network, remote access equipment, a slot monitoring system, a slot player tracking system, the Internet, a server, and/or any combination thereof.

Device interface 116 may be utilized to connect a player to electronic gaming device 100 through a mobile device, card, keypad, identification device 118, and/or any combination thereof. Device interface 116 may include a docking station by which a mobile device is plugged into electronic gaming machine 100. Device interface 116 may include an over the air connection by which a mobile device is connected to electronic gaming machine 100 (e.g., Bluetooth, Near Field technology, and/or Wi-Fi technology). Device interface 116 may include a connection to identification device 118.

Identification device 118 may be utilized to determine an identity of a player. Based on information obtained by identification device 118, electronic gaming device 100 may be reconfigured. For example, the language, sound level, music, placement of multi-media streams, one or more game functionalities (e.g., game type 1, game type 2, game type 3, etc.) may be presented, a reel exposing gaming option may be presented, a repeat payline gaming option may be presented, a pattern gaming option may be presented, historical gaming data may be presented, a row rearrangement option may be presented, a column rearrangement option may be presented, a row area rearrangement option may be presented, a column area rearrangement option may be presented, a two-dimensional gaming option may be presented, a three-dimensional gaming option may be presented, and/or the placement of gaming options may be modified based on player preference data. For example, the player may only want to play games that include reel exposing gaming options only. Therefore, only games which include reel exposing gaming options would be presented to the player. In another example, the player may only want to play games that include historical information relating to game play. Therefore, only games which include historical gaming data would be presented to the player. These examples may be combined.

Identification device 118 may utilize biometrics (e.g., thumb print, retinal scan, or other biometric). Identification device 118 may include a card entry slot into input device 112. Identification device 118 may include a keypad with an assigned pin number for verification. Identification device 118 may include multiple layers of identification for added security. For example, a player could be required to enter a player tracking card, and/or a pin number, and/or a thumb print, and/or any combination thereof. Based on information obtained by identification device 118, electronic gaming device 100 may be reconfigured. For example, the language, sound level, music, placement of video streams, placement of images, and the placement of gaming options utilized may be modified based on a player's preference data. For example, a player may have selected baseball under the sporting event preferences; electronic gaming device 100 will then automatically display the current baseball game onto side display screen 108 and/or an alternate display screen as set in the player's options.

First display screen 102 may be a liquid crystal display ("LCD"), a cathode ray tube display ("CRT"), organic light-emitting diode display ("OLED"), plasma display panel ("PDP"), electroluminescent display ("ELD"), a light-emitting diode display ("LED"), or any other display technology. First display screen 102 may be used for displaying primary games or secondary (bonus) games, to display one or more warnings relating to one or more audio devices, one or more display devices, one or more electrical wires, one or more springs, one or more motors, one or more adjustable devices, and/or one or more sensors, advertising, player attractions, electronic gaming device 100 configuration parameters and settings, game history, accounting meters, events, alarms, and/or any combination thereof. Second display screen 104, third display screen 106, side display screen 108, and any other screens may utilize the same technology as first display screen 102 and/or any combination of technologies.

First display screen 102 may also be virtually combined with second display screen 104. Likewise second display screen 104 may also be virtually combined with third display screen 106. First display screen 102 may be virtually combined with both second display screen 104 and third display screen 106. Any combination thereof may be formed.

For example, a single large image could be partially displayed on second display screen 104 and partially displayed on third display screen 106, so that when both display screens are put together they complete one image. Electronic gaming device 100 may stream or play prerecorded multi-media data, which may be displayed on any display combination.

One or more cameras 120 and/or one or more sensors 122 may be utilized as one or more depth image sensing devices, which may be located in various locations, including but not limited to, above the base display, above second display, in one or more locations on gaming cabinet front, on a side of the gaming cabinet other than gaming cabinet front, and/or any other location.

In one embodiment, electronic gaming device 100 may not include separate one or more input devices, but instead may only utilize one or more depth image sensing devices. In another embodiment, a player may utilize one or more input devices and/or may utilize gestures that electronic gaming device 100, via one or more depth image sensing devices, recognizes in order to make inputs for a play of a game. A player may interact with electronic gaming device 100 via one or more depth image sensing devices for a plurality of various player inputs.

In one embodiment, one or more depth image sensing devices may include at least two similar devices. For example, each of the at least two similar devices may independently sense depth and/or image of a scene. In another example, such similar depth image sensing devices may then communicate information to one or more processors, which may utilize the information from each of the similar depth image sensing devices to determine the relative depth of an image from a captured scene.

In another embodiment, one or more depth image sensing devices may include at least two different devices. For example, and discussed in more detail below, one of the at least two different devices may be an active device and/or one of the at least two different devices may be a passive device. In one example, such an active device may generate a wave of measurable energy (e.g., light, radio, etc.). In another example, such a passive device may be able to detect reflected waves generated by such an active device. In another example, such an active device and such a passive device may each communicate data related to their respective activity to a processor, and such processor may translate such data in order to determine the depth and/or image of a scene occurring near electronic gaming device 100.

Electronic gaming device 100 may include at least one display device. Electronic gaming device 100 may include a base display and/or a second display. In one embodiment, base display may be the primary display for a first game. In another embodiment, second display may be the primary display for a second and/or bonus game. For example, base display may display: a reel-type video slot game; and upon a bonus game triggering condition; second display may display a bonus game; and upon a reel exposing game feature triggering event; first and/or second display may display a reel exposing game feature.

In one embodiment, base display and second display may display separate portions of a common image. For example, second display may display a top portion of a wheel spinning while base display may display the bottom portion of the same wheel spinning.

Electronic gaming device 100 may also include one or more speakers. In one embodiment, one or more speakers may work in a synchronized manner to provide a surround sound effect. For example, as an object is displayed moving across base display from left to right, one or more speakers may produce sound in such a manner as to create an audible sense of similar left to right movement. In another embodiment, one or more speakers may work asynchronously. In a further embodiment, a first speaker may produce sounds associated with a first symbol appearing in a play of a game, and a second speaker may produce sounds associated with a second symbol appearing in a play of the game.

Figure 2:
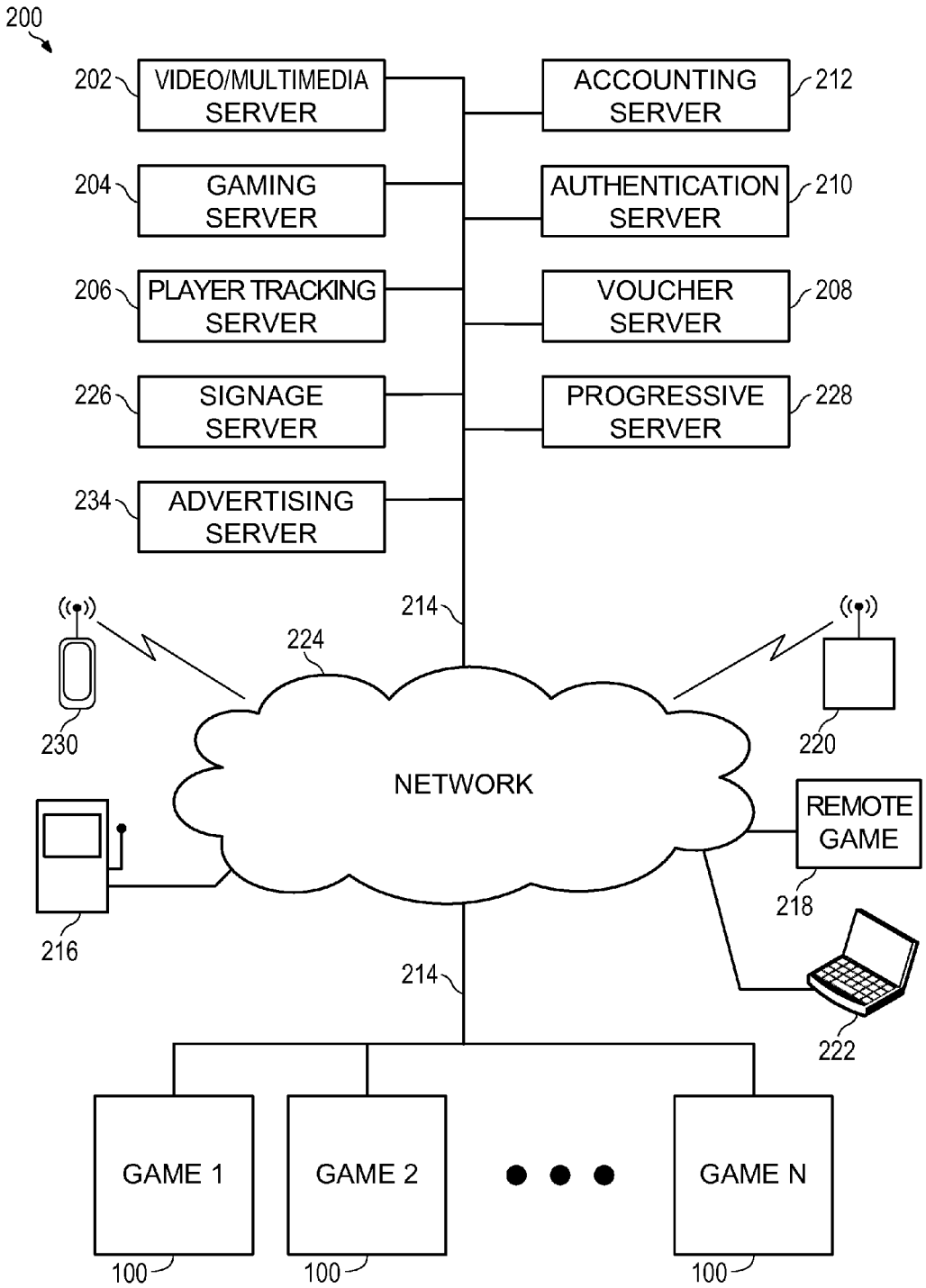
FIG. 2 is an illustration of an electronic gaming system, according to one embodiment.

In FIG. 2, an electronic gaming system 200 is shown. Electronic gaming system 200 may include a video/multimedia server 202, a gaming server 204, a player tracking server 206, a voucher server 208, an authentication server 210, and an accounting server 212.

Electronic gaming system 200 may include video/multimedia server 202, which may be coupled to network 224 via a network link 214. Network 224 may be the Internet, a private network, and/or a network cloud. One or more video streams may be received at video/multimedia server 202 from other electronic gaming devices 100. Video/multimedia server 202 may transmit one or more of these video streams to a mobile phone 230, electronic gaming device 100, a remote electronic gaming device at a different location in the same property 216, a remote electronic gaming device at a different location 218, a laptop 222, and/or any other remote electronic device 220. Video/multimedia server 202 may transmit these video streams via network link 214 and/or network 224.

For example, a remote gaming device at the same location may be utilized at a casino with multiple casino floors, a casino that allows wagering activities to take place from the hotel room, a casino that may allow wagering activities to take place from the pool area, etc. In another example, the remote devices may be at another location via a progressive link to another casino, and/or a link within a casino corporation that owns numerous casinos (e.g., MGM, Caesars, etc.).

Gaming server 204 may generate gaming outcomes. Gaming server 204 may provide electronic gaming device 100 with game play content. Gaming server 204 may provide electronic gaming device 100 with game play math and/or outcomes. Gaming server 204 may provide one or more of: a reel exposing game feature functionality; a reel exposing game feature evaluation functionality; a payout functionality; a base and/or bonus game play functionality; a base and/or bonus game play evaluation functionality, other game functionality, and/or any other virtual game functionality.

Player tracking server 206 may track a player's betting activity, a player's preferences (e.g., language, font, sound level, drinks, etc.). Based on data obtained by player tracking server 206, a player may be eligible for gaming rewards (e.g., free play), promotions, and/or other awards (e.g., complimentary food, drinks, lodging, concerts, etc.).

Voucher server 208 may generate a voucher, which may include data relating to gaming. Further, the voucher may include payline structure option selections. In addition, the voucher may include game play data (or similar game play data), repeat payline data, pattern data, historical payout data, column data, row data, and/or symbols that were modified.

Authentication server 210 may determine the validity of vouchers, player's identity, and/or an outcome for a gaming event.

Accounting server 212 may compile, track, and/or monitor cash flows, voucher transactions, winning vouchers, losing vouchers, and/or other transaction data. Transaction data may include the number of wagers, the size of these wagers, the date and time for these wagers, the identity of the players making these wagers, and/or the frequency of the wagers. Accounting server 212 may generate tax information relating to these wagers. Accounting server 212 may generate profit/loss reports for players' tracked outcomes.

Network connection 214 may be used for communication between dedicated servers, thin clients, thick clients, back-office accounting systems, etc.

Laptop computer 222 and/or any other electronic devices (e.g., mobile phone 230, electronic gaming device 100, etc.) may be used for downloading new gaming device applications or gaming device related firmware through remote access.

Laptop computer 222 and/or any other electronic device (e.g., mobile phone 230, electronic gaming device 100, etc.) may be used for uploading accounting information (e.g., cashable credits, non-cashable credits, coin in, coin out, bill in, voucher in, voucher out, etc.).

Network 224 may be a local area network, a casino premises network, a wide area network, a virtual private network, an enterprise private network, the Internet, or any combination thereof. Hardware components, such as network interface cards, repeaters and hubs, bridges, switches, routers, firewalls, or any combination thereof may also be part of network 224.

A statistics server may be used to maintain data relating to historical game play for one or more electronic gaming devices 100. This historical data may include winning amounts, winning data (e.g., person, sex, age, time on machine, amount of spins before winning event occurred, etc.), fastest winning event reoccurrence, longest winning event reoccurrence, average frequencies of winning events, average winning amounts, highest winning amount, lowest winning amount, locations for winning events, winning event dates, winning machines, winning game themes, and/or any other data relating to game play.

Figure 3:
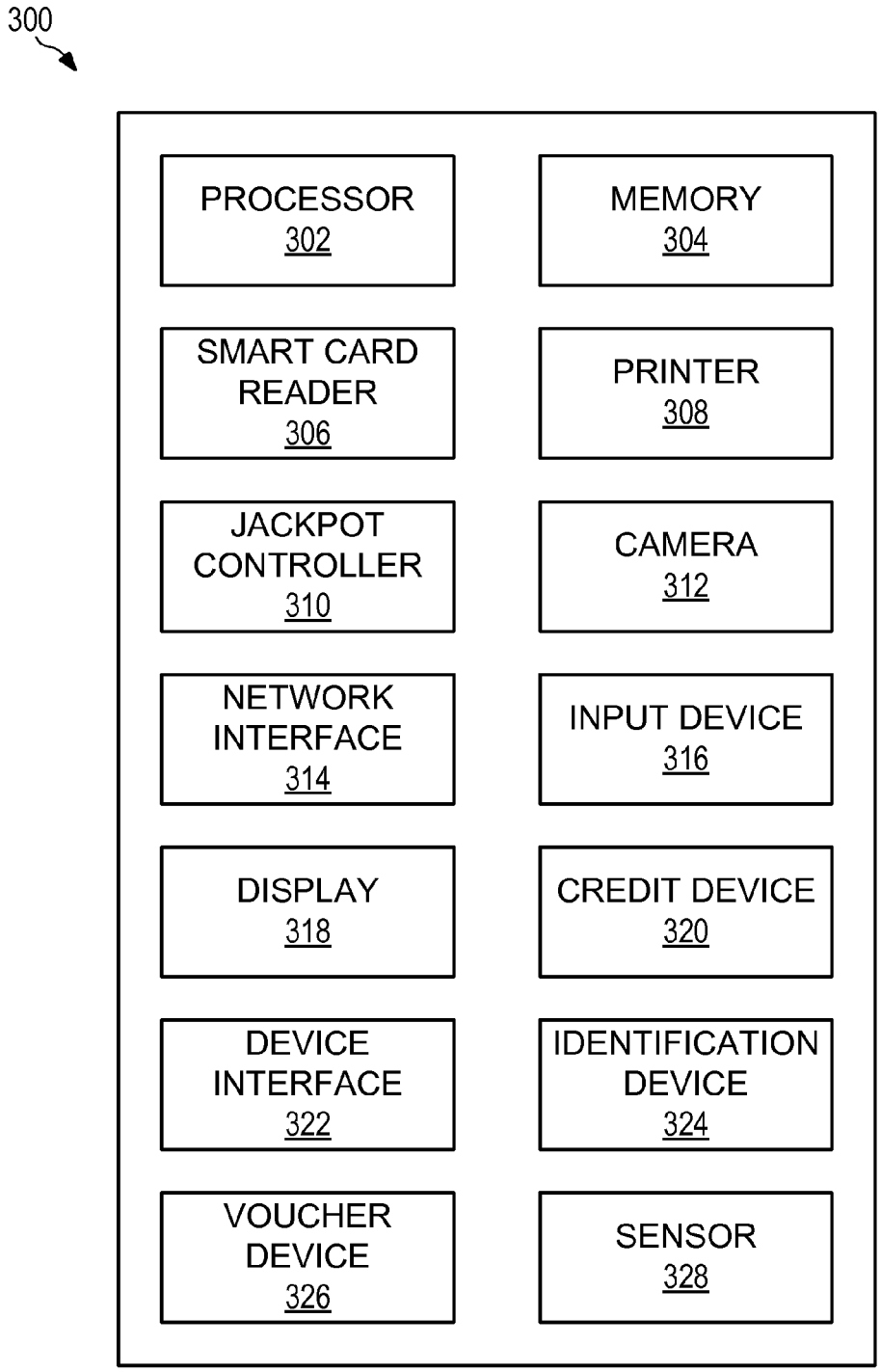
FIG. 3 is a block diagram of the electronic gaming device, according to one embodiment.

FIG. 3 shows a block diagram 300 of electronic gaming device 100.

Electronic gaming device 100 may include a processor 302, a memory 304, a smart card reader 306, a printer 308, a jackpot controller 310, a camera 312, a network interface 314, an input device 316, a display 318, a credit device 320, a device interface 322, an identification device 324, and a voucher device 326.

Processor 302 may execute program instructions of memory 304 and use memory 304 for data storage. Processor 302 may also include a numeric co-processor, or a graphics processing unit (or units) for accelerated video encoding and decoding, and/or any combination thereof.

Processor 302 may include communication interfaces for communicating with electronic gaming device 100, electronic gaming system 200, and user interfaces to enable communication with all gaming elements. For example, processor 302 may interface with memory 304 to access a player's mobile device through device interface 322 to display contents onto display 318. Processor 302 may generate a voucher based on a wager confirmation, which may be received by an input device, a server, a mobile device, and/or any combination thereof. A voucher device may generate, print, transmit, or receive a voucher. Memory 304 may include communication interfaces for communicating with electronic gaming device 100, electronic gaming system 200, and user interfaces to enable communication with all gaming elements. For example, the information stored on memory 304 may be printed out onto a voucher by printer 308. Videos or pictures captured by camera 312 may be saved and stored on memory 304. Memory 304 may include a confirmation module, which may authenticate a value of a voucher and/or the validity of the voucher. Processor 302 may determine the value of the voucher based on generated voucher data and data in the confirmation module. Electronic gaming device 100 may include a player preference input device. The player preference input device may modify a game configuration. The modification may be based on data from the identification device.

Memory 304 may be non-volatile semiconductor memory, such as read-only memory ("ROM"), erasable programmable read-only memory ("EPROM"), electrically erasable programmable read-only memory ("EEPROM"), flash memory ("NVRAM"), Nano-RAM (e.g., carbon nanotube random access memory), and/or any combination thereof.

Memory 304 may also be volatile semiconductor memory such as, dynamic random access memory ("DRAM"), static random access memory ("SRAM"), and/or any combination thereof.

Memory 304 may also be a data storage device, such as a hard disk drive, an optical disk drive such as, CD, DVD, Blu-ray, a solid state drive, a memory stick, a CompactFlash card, a USB flash drive, a Multi-media Card, an xD-Picture Card, and/or any combination thereof.

Memory 304 may be used to store read-only program instructions for execution by processor 302, for the read-write storage for global variables and static variables, read-write storage for uninitialized data, read-write storage for dynamically allocated memory, for the read-write storage of the data structure known as "the stack," and/or any combination thereof.

Memory 304 may be used to store the read-only paytable information for which symbol combinations on a given payline that result in a win (e.g., payout) which are established for games of chance, such as slot games and video poker.

Memory 304 may be used to store accounting information (e.g., cashable electronic promotion in, non-cashable electronic promotion out, coin in, coin out, bill in, voucher in, voucher out, electronic funds transfer in, etc.).

Memory 304 may be used to record error conditions on an electronic gaming device 100, such as door open, coin jam, ticket print failure, ticket (e.g., paper) jam, program error, reel tilt, etc., and/or any combination thereof.

Memory 304 may also be used to record the complete history for the most recent game played, plus some number of prior games as may be determined by the regulating authority.

Smart card reader 306 may allow electronic gaming device 100 to access and read information provided by the player or technician, which may be used for setting the player preferences and/or providing maintenance information. For example, smart card reader 306 may provide an interface between a smart card (inserted by the player) and identification device 324 to verify the identity of a player.

Printer 308 may be used for printing slot machine payout receipts, slot machine wagering vouchers, non-gaming coupons, slot machine coupons (e.g., a wagering instrument with a fixed waging value that can only be used for non-cashable credits), drink tokens, comps, and/or any combination thereof.

Electronic gaming device 100 may include a jackpot controller 310, which may allow electronic gaming device 100 to interface with other electronic gaming devices either directly or through electronic gaming system 200 to accumulate a shared jackpot.

Camera 312 may allow electronic gaming device 100 to take images of a player or a player's surroundings. For example, when a player sits down at the machine his or her picture may be taken to include his or her image into the game play. A picture of a player may be an actual image as taken by camera 312. A picture of a player may be a computerized caricature of the image taken by camera 312. The image obtained by camera 312 may be used in connection with identification device 324 using facial recognition. Camera 312 may allow electronic gaming device 100 to record video. The video may be stored on memory 304 or stored remotely via electronic gaming system 200. Videos obtained by camera 312 may then be used as part of game play, or may be used for security purposes. For example, a camera located on electronic gaming device 100 may capture videos of a potential illegal activity (e.g., tampering with the machine, crime in the vicinity, underage players, etc.).

Network interface 314 may allow electronic gaming device 100 to communicate with video/multimedia server 202, gaming server 204, player tracking server 206, voucher server 208, authentication server 210, and/or accounting server 212.

Input device 316 may be mechanical buttons, electronic buttons, a touch screen, and/or any combination thereof. Input device 316 may be utilized to make a wager, to select one or more game elements, to select one or more gaming options, to make an offer to buy or sell a voucher, to determine a voucher's worth, to cash in a voucher, to modify electronic gaming device 100 (e.g., change sound level, configuration, font, language, etc.), to modify one of one or more audio devices, one or more display devices, one or more electrical wires, one or more springs, one or more motors, one or more adjustable devices, and/or one or more sensors, to select a movie or music, to select live video streams (e.g., sporting event 1, sporting event 2, sporting event 3), to request services (e.g., drinks, manager, etc.), and/or any combination thereof.

Display 318 may show video streams from one or more content sources. Display 318 may encompass first display screen 102, second display screen 104, third display screen 106, side display screen 108, and/or another screen used for displaying video content.

Credit device 320 may be utilized to collect monies and distribute monies (e.g., cash, vouchers, etc.). Credit device 320 may interface with processor 302 to allow game play to take place. Processor 302 may determine any payouts, display configurations, animation, and/or any other functions associated with game play. Credit device 320 may interface with display 318 to display the amount of available credits for the player to use for wagering purposes. Credit device 320 may interface via device interface 322 with a mobile device to electronically transmit money and/or credits. Credit device 320 may interface with a player's pre-established account, which may be stored on electronic gaming system 200, to electronically transmit money and/or credit. For example, a player may have a credit card or other mag-stripe card on file with the location for which money and/or credits can be directly applied when the player is done. Credit device 320 may interface with a player's card to exchange player points.

Electronic gaming device 100 may include a device interface 322 that a user may employ with his or her mobile device (e.g., smart phone) to receive information from and/or transmit information to electronic gaming device 100 (e.g., watch a movie, listen to music, obtain verbal betting options, verify identification, transmit credits, etc.).

Identification device 324 may be utilized to allow electronic gaming device 100 to determine an identity of a player. Based on information obtained by identification device 324, electronic gaming device 100 may be reconfigured. For example, the language, sound level, music, placement of video streams, placement of images, placement of gaming options, and/or the tables utilized may be modified based on player preference data.

For example, a player may have selected a specific baseball team (e.g., Atlanta Braves) under the sporting event preferences, the electronic gaming device 100 will then automatically (or via player input) display the current baseball game (e.g., Atlanta Braves vs. Philadelphia Phillies) onto side display screen 108 and/or an alternate display screen as set in the player's options.

A voucher device 326 may generate, print, transmit, or receive a voucher. The voucher may represent a wagering option, a wagering structure, a wagering timeline, a value of wager, a payout potential, a payout, and/or any other wagering data. A voucher may represent an award, which may be used at other locations inside of the gaming establishment. For example, the voucher may be a coupon for the local buffet or a concert ticket.

Figure 4:
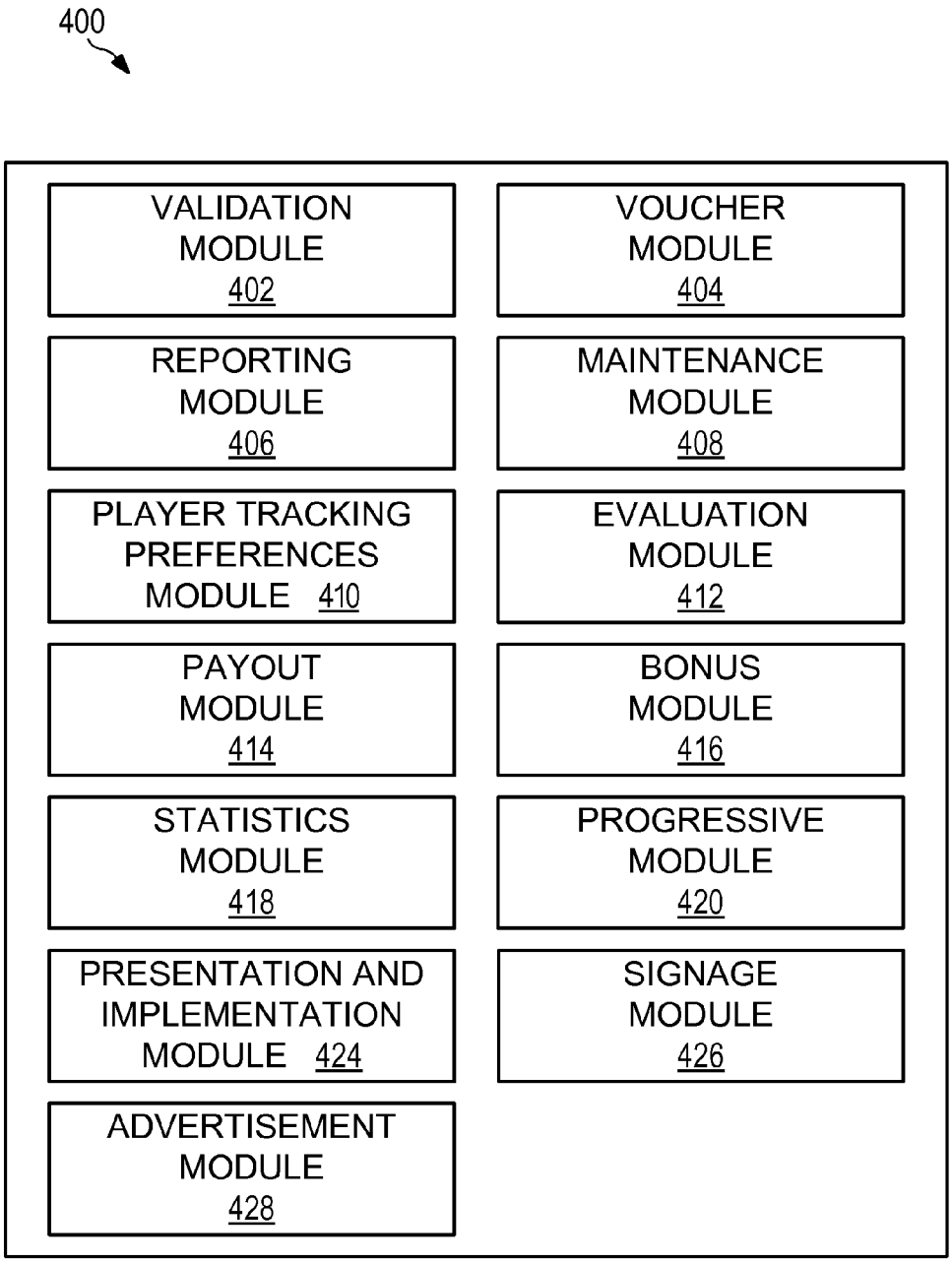
FIG. 4 is another block diagram of the electronic gaming device, according to one embodiment.

FIG. 4 shows a block diagram of memory 304, which includes various modules. Memory 304 may include a validation module 402, a voucher module 404, a reporting module 406, a maintenance module 408, a player tracking preferences module 410, an animation module, a game evaluation module 412, a payout module 414, a sensor module, a scene module, a sensor and scene evaluation module, a sensor and scene output module, a reference models module, an audio module, an audio device adjustment module, a display device adjustment module, a bonus module 416, a statistics module 418, a progressive module 420, a presentation and implementation module 424, a signage module 426, an advertisement module 428, a wild module, and a scatter module.

Validation module 402 may utilize data received from voucher device 326 to confirm the validity of the voucher.

Voucher module 404 may store data relating to generated vouchers, redeemed vouchers, bought vouchers, and/or sold vouchers.

Reporting module 406 may generate reports related to a performance of electronic gaming device 100, electronic gaming system 200, video streams, gaming objects, credit device 114, and/or identification device 118.

Maintenance module 408 may track any maintenance that is implemented on electronic gaming device 100 and/or electronic gaming system 200. Maintenance module 408 may schedule preventative maintenance and/or request a service call based on a device error.

Player tracking preferences module 410 may compile and track data associated with a player's preferences.

Animation module may generate, compile, transmit, and/or store one or more animations and/or presentations based on one or more scene data, one or more scenes, one or more reference models, one or more game play data, one or more player profiles, and/or any combination thereof.

Game evaluation module 412 may evaluate one or more outcomes for one or more events relating to game play.

Payout module 414 may determine one or more payouts which may relate to one or more inputs received from the player, electronic gaming device 100, and/or electronic gaming system 200.

Sensor module may generate, compile, transmit, and/or store any data relating to one or more scene data, one or more scene, and/or any other sensor data. This data may include one or more gestures (e.g., body movement made by one or more players).

Scene module may generate, compile, transmit, and/or store on one or more scene data, one or more scenes, one or more reference models, one or more game play data, one or more player profiles, and/or any combination thereof.

Sensor and scene evaluation module may evaluate any data stored on, transmitted to, and/or transmitted from sensor module and scene module. Sensor and scene evaluation module may obtain data including one or more gestures (e.g., body movement made by one or more players) from sensor module and compare this data to one or more body reference models, body part reference models, device reference models, gaming device reference models, floor plan reference models, and/or any other reference models from reference models module to determine one or more actions.

Sensor and scene output module may evaluate the combined output of sensor module and scene module.

Reference models module may generate, compile, transmit, and/or store one or more body reference models, body part reference models, device reference models, gaming device reference models, floor plan reference models, and/or any other reference models which can be utilized by any of the other modules.

Audio module may generate, compile, transmit, and/or store one or more audio structures, sound wave configurations, and/or any other audio data.

Audio device adjustment module may adjust one or more audio devices. These devices may be adjusted physically (e.g., moved) and/or by changing one or more device characteristics.

Display device adjustment module may adjust one or more display devices. These devices may be adjusted physically (e.g., moved) and/or by changing one or more device characteristics.

Bonus module 416 may generate a bonus game, evaluate the results of the bonus game, trigger bonus game presentations, generate bonus game payouts, and/or display any data relating to the bonus game.

Statistics module 418 may be used to maintain data relating to historical game play for one or more electronic gaming devices 100. This historical data may include winning amounts, winning data (e.g., person, sex, age, time on machine, amount of spins before winning event occurred, etc.), fastest winning event reoccurrence, longest winning event reoccurrence, average frequencies of winning events, average winning amounts, highest winning amount, lowest winning amount, locations for winning events, winning event dates, winning machines, winning game themes, and/or any other data relating to game play.

Progressive module 420 may generate, transmit, compile, and/or store one or more data points relating to one or more progressives and/or subscription progressives (e.g., a progressive a player selects and pays to enter).

Presentation and implementation module 424 may generate, transmit, compile, implement, and/or store one or more presentations.

Signage module 426 may generate, transmit, compile, initiate, and/or store one or more presentations for one or more signs.

Advertisement module 428 may generate, transmit, compile, present, implement, initiate, and/or store one or more advertisements.

Wild module may generate a wild game, evaluate the results of the wild game, trigger wild game presentations, generate wild game payouts, and/or display any data relating to the wild game. Further, wild module may determine one or more outcomes of one or more interactions (e.g., collisions of one or more symbols).

Scatter module may generate a scatter game, evaluate the results of the scatter game, trigger scatter game presentations, generate scatter game payouts, and/or display any data relating to the scatter game.

Super reel exposing module may generate a super reel exposing game, evaluate the results of the super reel exposing game, trigger super reel exposing game presentations, generate super reel exposing game payouts, and/or display any data relating to the super reel exposing game. Further, super reel exposing module may determine one or more outcomes of one or more interactions (e.g., collisions of one or more symbols). Super reel exposing may be where one or more symbols are moved from one or more revealed areas and moved around the active reels for multiple spins. For example, a wild is dropped from the revealed area to a first symbol area for a first spin and then the same wild is moved to a second symbol area for a second spin and then the same wild is moved to a third symbol area for an Nth spin.

Reel exposing evaluation module and/or game evaluation module 412 may evaluate one or more outcomes for one or more events relating to reel exposing game play. Further, reel exposing evaluation module may determine one or more outcomes of one or more interactions (e.g., collisions of one or more symbols).

Collection area module may work with reel exposing counter module to transfer one or more collected symbols to one or more collection locations and/or one or more active areas (e.g., symbol areas on one or more reels).

Installation verification module may verify the installation parameters on one or more of audio devices, one or more display devices, one or more electrical wires, one or more springs, one or more motors, one or more adjustable devices, and/or one or more sensors to one or more reference data points. Installation verification module may generate a warning when the data points are outside of a specific parameter range. One or more warnings may be transmitted to an external device, a server, a mobile device, and/or a warning display on electronic gaming device 100 based on the verification data.

Locking module may control the locking mechanism for one or more audio devices, one or more display devices, one or more electrical wires, one or more springs, one or more motors, one or more adjustable devices, and/or one or more sensors. Locking module may control any locking mechanism for electronic gaming device 100. Locking module may generate a warning when a locking data point is outside of a specific parameter. These warnings may be transmitted to an external device, a server, a mobile device, and/or a warning display on electronic gaming device 100.

It should be noted that one or more modules may be combined into one module. Further, there may be one evaluation module where the determined payout does not depend on whether there were any wild symbols, scatter symbols, treasure based game play, and/or any other specific symbols. Further, any module, device, and/or logic function in electronic gaming device 100 may be present in electronic gaming system 200. In addition, any module, device, and/or logic function in electronic gaming system 200 may be present in electronic gaming device 100.

Figure 5A:
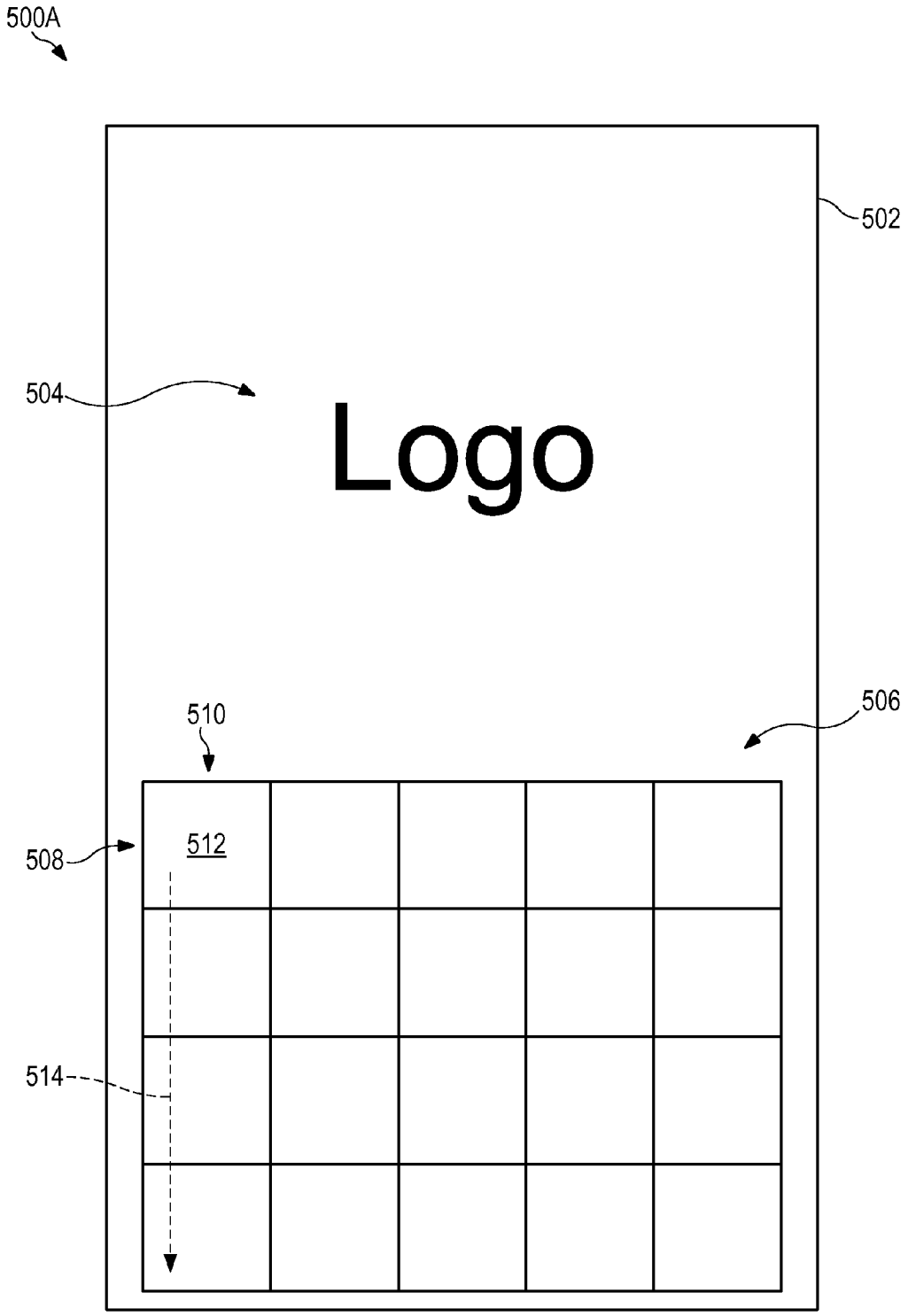
FIG. 5A is an illustration of reel exposing game play on a gaming device, according to one embodiment.

In FIG. 5A, an illustration of reel exposing game play on a gaming device is shown, according to one embodiment. A first image 500A may include a screen 502, a logo area 504, one or more reels 506, one or more rows 508, one or more columns 510, and one or more symbol areas 512. In one example, one or more reels 506 may rotate in a first direction 514. In this example, the one or more reels 506 have a display area which remains constant (e.g., 4×5 matrix). Therefore, the display area remains a 4×5 matrix. In this example, logo area 504 may be utilized to display one or more advertisements, one or more secondary games, one or more tournament leader board data, and/or to display any other gaming data. In this example, one or more reels 506 equals 5 reels. Further, there are four rows (e.g., one or more rows 508) and five columns (e.g., one or more columns 510).

Figure 5B:
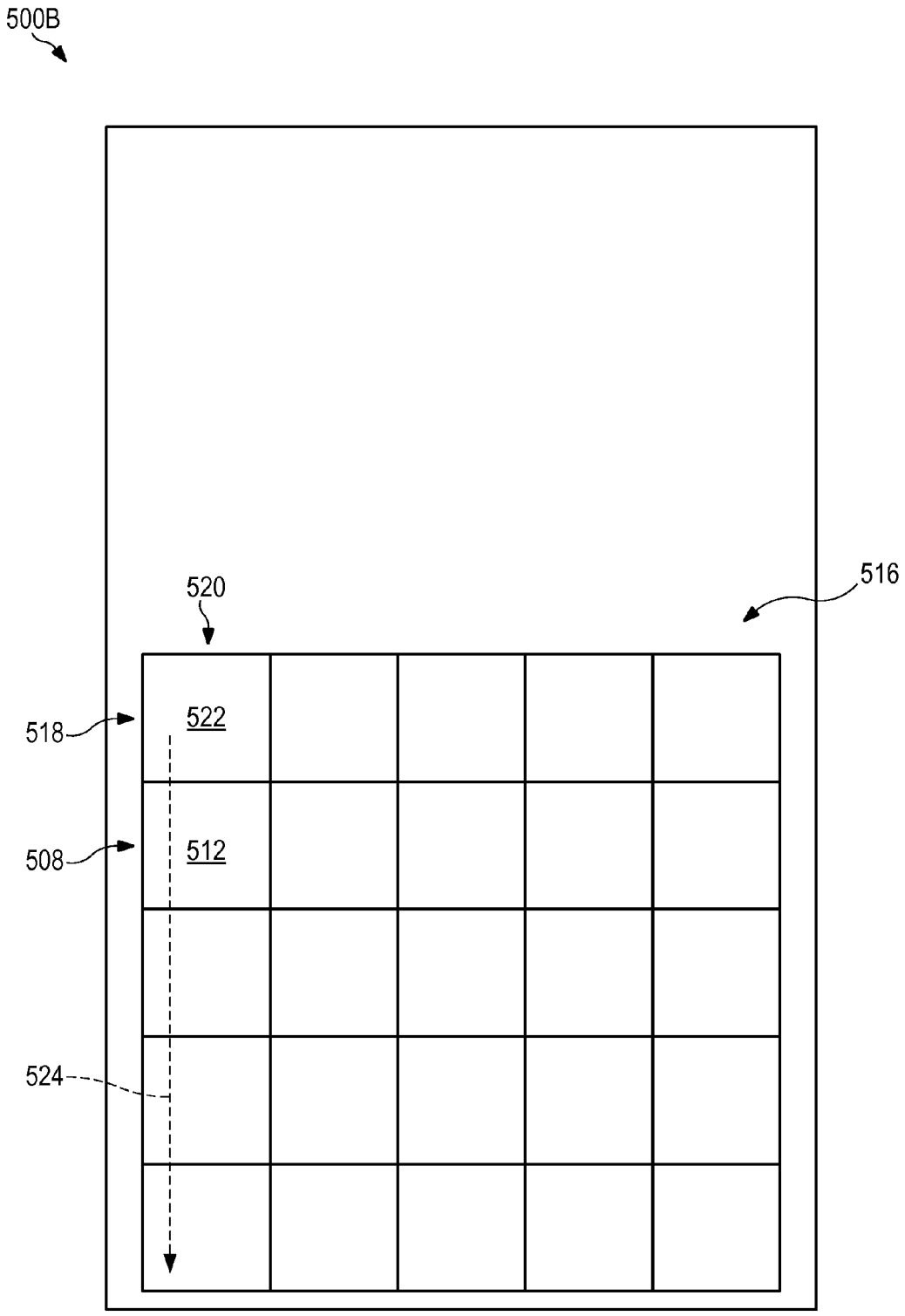
FIG. 5B is another illustration of reel exposing game play on a gaming device, according to one embodiment.

In FIG. 5B, another illustration of reel exposing game play on a gaming device is shown, according to one embodiment. A second image 500B may include a first revealed area 518 which may include one or more first revealed areas 522. In this example, as one or more reels 506 spins in a direction (e.g., first direction 514, a second direction 524, etc.) first revealed area 518 may be displayed and/or revealed. During a normal spin mode, one or more rows 508 and/or one or more columns 510 may display symbols in one or more active reel areas where one or more paylines may be formed. During a reveal additional inactive reel areas where no paylines may be formed, first revealed area 518 may display one or more symbol in one or more inactive reel areas. In this example, the player's excitement may be increased because the player can anticipate where one or more symbols may land on one or more active reel areas by seeing the one or more symbol movements on one or more inactive reel areas.

Figure 5C:
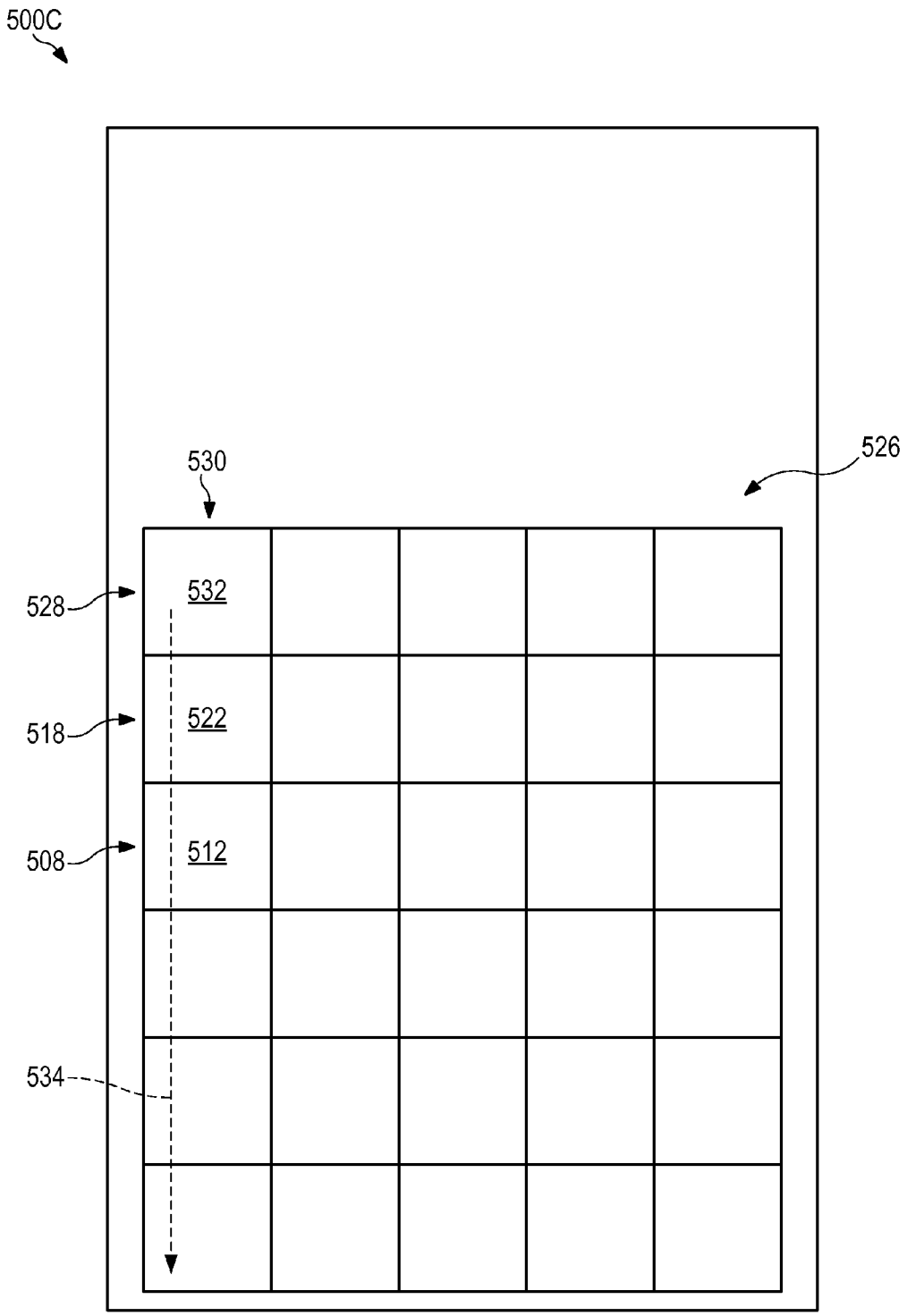
FIG. 5C is another illustration of reel exposing game play on a gaming device, according to one embodiment.

In FIG. 5C, another illustration of reel exposing game play on a gaming device is shown, according to one embodiment. A third image 500C may include a second revealed area 528 which may include one or more second revealed areas 532 and first revealed area 518 with one or more first revealed areas 522. In this example, as one or more reels 506 spins in a direction (e.g., first direction 514, second direction 524, a third direction 534, etc.) first revealed area 518 and/or second revealed area 528 may be displayed and/or revealed. During a normal spin mode, one or more rows 508 and/or one or more columns 510 may display symbols in one or more active reel areas where one or more paylines may be formed. During a reveal additional inactive reel areas where no paylines may be formed, first revealed area 518 and/or second revealed areas 528 may display one or more symbol in one or more inactive reel areas. In this example, the player's excitement may be increased because the player can anticipate where one or more symbols may land on one or more active reel areas by seeing the one or more symbol movements on one or more inactive reel areas. Note, that in normal base game mode, these revealed areas would not be shown. In other words, during normal base game symbol generation mode only symbols utilized in the active area would be shown.

Figure 5D:
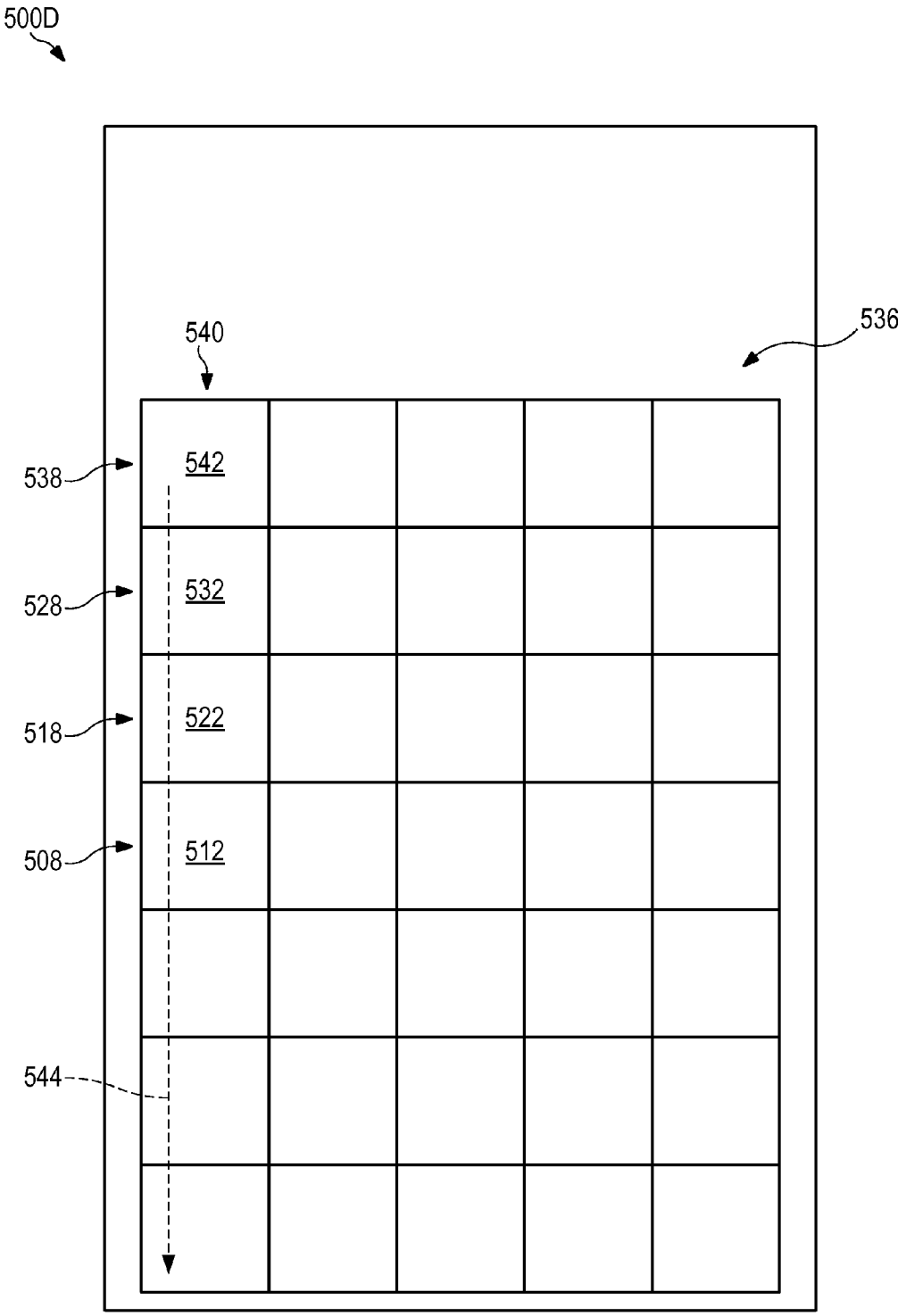
FIG. 5D is another illustration of reel exposing game play on a gaming device, according to one embodiment.

In FIG. 5D, another illustration of reel exposing game play on a gaming device is shown, according to one embodiment. A fourth image 500D may include a third revealed area 538 with one or more third revealed areas 542, second revealed area 528 which may include one or more second revealed areas 532, and first revealed area 518 with one or more first revealed areas 522. In this example, as one or more reels 506 spins in a direction (e.g., first direction 514, second direction 524, third direction 534, a fourth direction 544, etc.) first revealed area 518, second revealed area 528, and/or a third revealed area 538 may be displayed and/or revealed. During a normal spin mode, one or more rows 508 and/or one or more columns 510 may display symbols in one or more active reel areas where one or more paylines may be formed but no symbols in one or more potential revealed areas are shown. During a reveal additional inactive reel areas where no paylines may be formed, first revealed areas 518 and/or second revealed areas 528 and/or third revealed areas 538 may display one or more symbol in one or more inactive reel areas. In this example, the player's excitement may be increased because the player can anticipate where one or more symbols may land on one or more active reel areas by seeing the one or more symbol movements on one or more inactive reel areas.

Figure 5E:
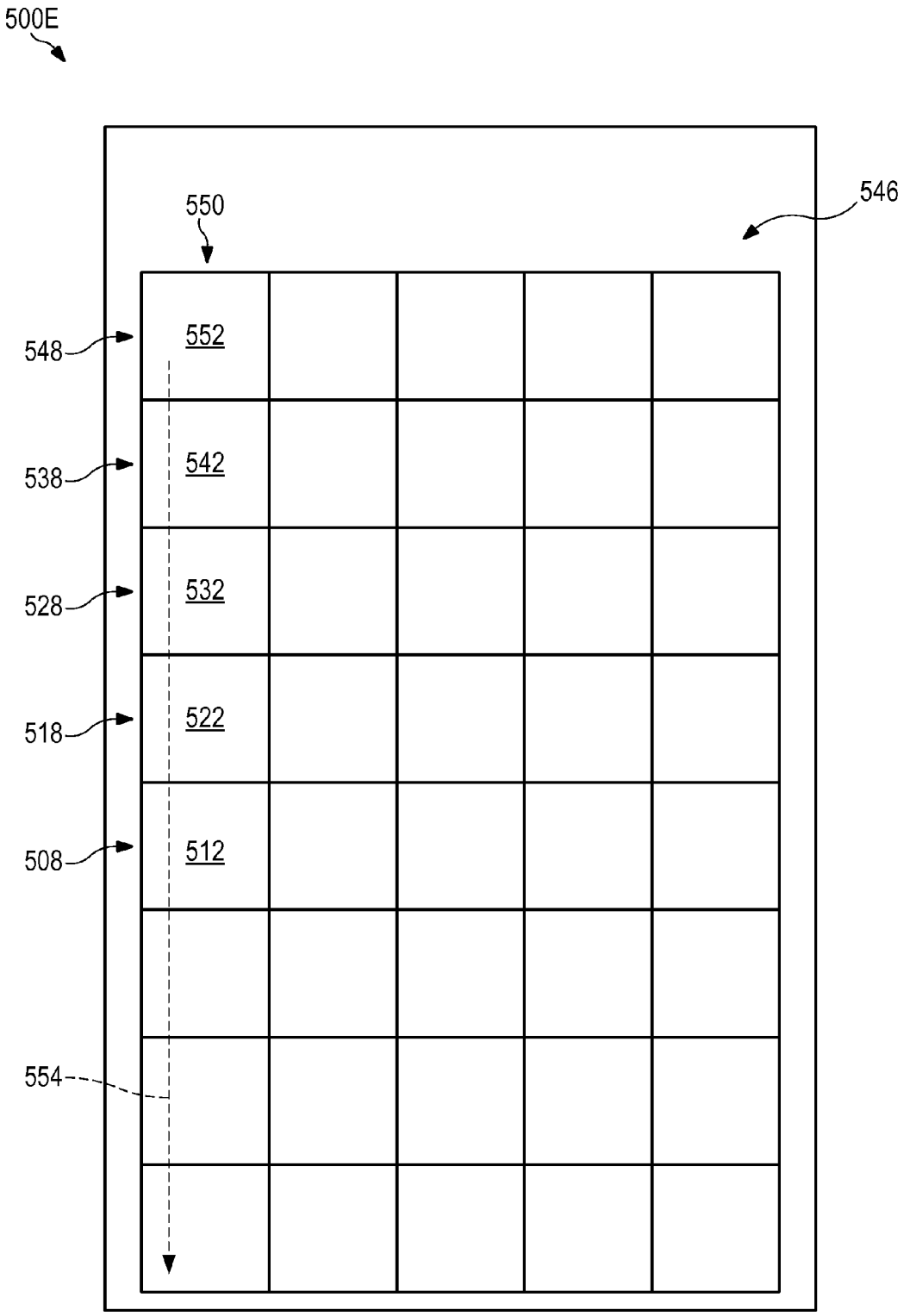
FIG. 5E is another illustration of reel exposing game play on a gaming device, according to one embodiment.

In FIG. 5E, another illustration of reel exposing game play on a gaming device is shown, according to one embodiment. A fifth image 500E may include a fourth revealed area 548 with one or more fourth revealed areas 552, third revealed area 538 with one or more third revealed areas 542, second revealed area 528 which may include one or more second revealed areas 532, and first revealed area 518 with one or more first revealed areas 522. In this example, as one or more reels 506 spins in a direction (e.g., first direction 514, second direction 524, third direction 534, fourth direction 544, a fifth direction 554,—directions may be in any direction and one or more reels/directions may change course) first revealed area 518, second revealed area 528, third revealed area 538, and/or fourth revealed area 548 may be displayed and/or revealed. During a normal spin mode, one or more rows 508 and/or one or more columns 510 may display symbols in one or more active reel areas where one or more paylines may be formed. During a reveal additional inactive reel areas where no paylines may be formed, first revealed areas 518 and/or second revealed areas 528 and/or third revealed areas 538 and/or fourth revealed area 548 may display one or more symbol in one or more inactive reel areas. In this example, the player's excitement may be increased because the player can anticipate where one or more symbols may land on one or more active reel areas by seeing the one or more symbol movements on one or more inactive reel areas.

Figure 5F:
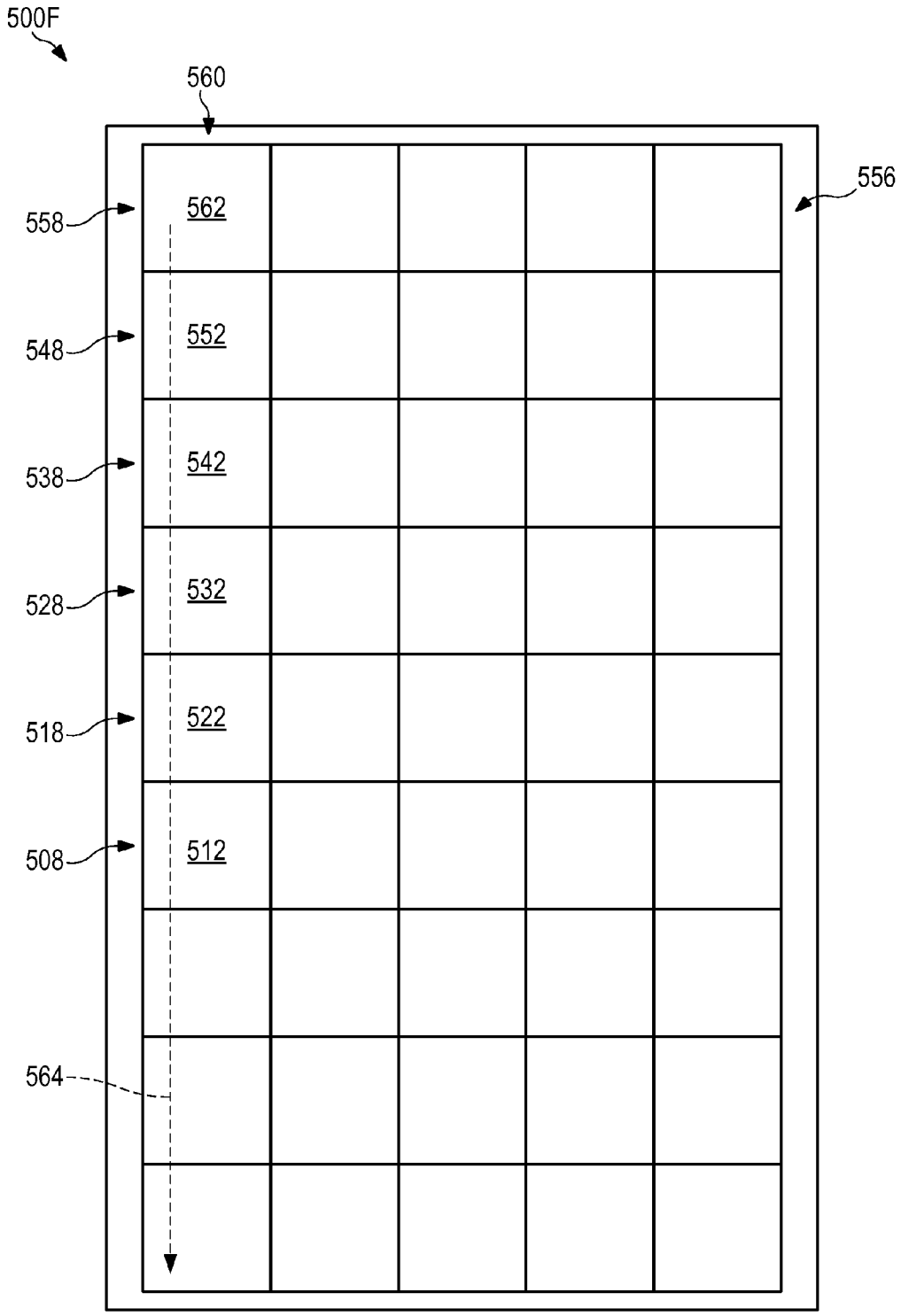
FIG. 5F is another illustration of reel exposing game play on a gaming device, according to one embodiment.

In FIG. 5F, another illustration of reel exposing game play on a gaming device is shown, according to one embodiment. A sixth image 500F may include a fifth revealed area 558 with one or more fifth revealed areas 562, fourth revealed area 548 with one or more fourth revealed areas 552, third revealed area 538 with one or more third revealed areas 542, second revealed area 528 which may include one or more second revealed areas 532, and first revealed area 518 with one or more first revealed areas 522. In this example, as one or more reels 506 spins in a direction (e.g., first direction 514, second direction 524, third direction 534, fourth direction 544, fifth direction 554, a sixth direction 564,—directions may be in any direction and may change course—for example, first direction may be going down and second direction may be going down but second direction may reverse course and goes up when third direction is initiated in an upward direction) first revealed area 518, second revealed area 528, third revealed area 538, fourth revealed area 548, and/or fifth revealed area 558 may be displayed and/or revealed. During a normal spin mode, one or more rows 508 and/or one or more columns 510 may display symbols in one or more active reel areas where one or more paylines may be formed. During a reveal additional inactive reel areas where no paylines may be formed, first revealed areas 518 and/or second revealed areas 528 and/or third revealed areas 538 and/or fourth revealed area 548 and/or fifth revealed areas 558 may display one or more symbol in one or more inactive reel areas. In this example, the player's excitement may be increased because the player can anticipate where one or more symbols may land on one or more active reel areas by seeing the one or more symbol movements on one or more inactive reel areas.

Figure 5G:
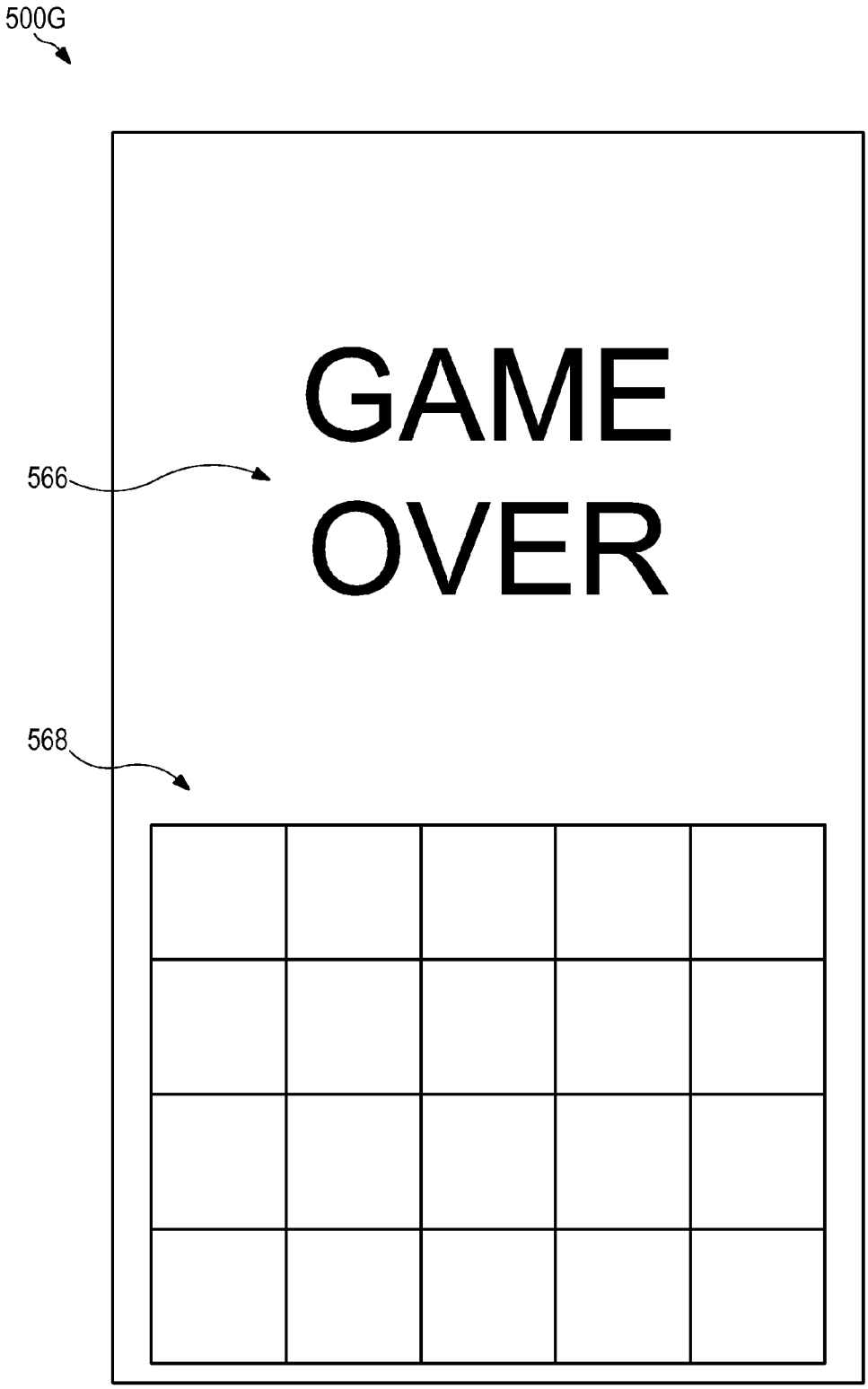
FIG. 5G is another illustration of reel exposing game play on a gaming device, according to one embodiment.

In FIG. 5G, another illustration of reel exposing game play on a gaming device is shown, according to one embodiment. In this example, fifth revealed area 558 with one or more fifth revealed areas 562, fourth revealed area 548 with one or more fourth revealed areas 552, third revealed area 538 with one or more third revealed areas 542, second revealed area 528 which may include one or more second revealed areas 532, and first revealed area 518 with one or more first revealed areas 522. In this example, as one or more reels 506 spins in a direction (e.g., first direction 514, second direction 524, third direction 534, fourth direction 544, fifth direction 554, a sixth direction 564,—directions may be in any direction and may change course—for example, first direction may be upward while second direction and third direction are downward and after 10 seconds (e.g., time period, spin number, etc.) all directions (or a portion of the directions) are reversed (or modified)—in another example, the speed of each reel may be different than the other reels) first revealed area 518, second revealed area 528, third revealed area 538, fourth revealed area 548, and/or fifth revealed area 558 may be displayed and/or revealed. During a normal spin mode, one or more rows 508 and/or one or more columns 510 may display symbols in one or more active reel areas where one or more paylines may be formed. During a reveal additional inactive reel areas where no paylines may be formed, first revealed areas 518 and/or second revealed areas 528 and/or third revealed areas 538 and/or fourth revealed area 548 and/or fifth revealed areas 558 may display one or more symbol in one or more inactive reel areas.

During normal base game play, there may be one or more active paylines in the base game area and no active paylines in one or more revealed areas. In another example, one or more paylines may be activated in the one or more revealed areas which only depend on the symbols in the one or more revealed areas. In another example, one or more paylines may be activated in the one or more revealed areas which depend on both one or more symbols in the one or more revealed areas and one or more symbols in the base game area.

In various examples, the revealed area may be shown fading in, fading out, simultaneously, in a block pattern, a step function, an X shape, a Y shape, and/or any other pattern. For example, first revealed area is displayed, then second revealed area is displayed, then third revealed area is displayed, etc. which is a block pattern. In another example, all of the first revealed area, second revealed area, and third revealed area may be displayed in a step function.

In another example, a special symbol may keep one or more revealed areas and/or payline activated in the revealed areas. In another example, a message area 566 may be utilized. In another example, a base game active area 568 with one or more paylines may be utilized.

In various examples, as one or more reels spin the revealed area may be generated and the revealed area may go in and out of a fading mode (straight line pattern, an x shape pattern, a v shape pattern, etc.). In another example, the player may select to stop one or more reels by provide a player input.

In various examples, a first revealed row may not be shown but a second revealed row may be shown. In other words, the revealed area displaying method does not have to be layered. could be that second revealed area is shown, then third revealed area is shown, and then first revealed area is shown, etc. In another example, it could be that only third revealed area is shown. In one example, it could be that third revealed area is shown and then five revealed area is shown but first revealed area, second revealed area, and fourth revealed area are not shown.

Figure 6A:
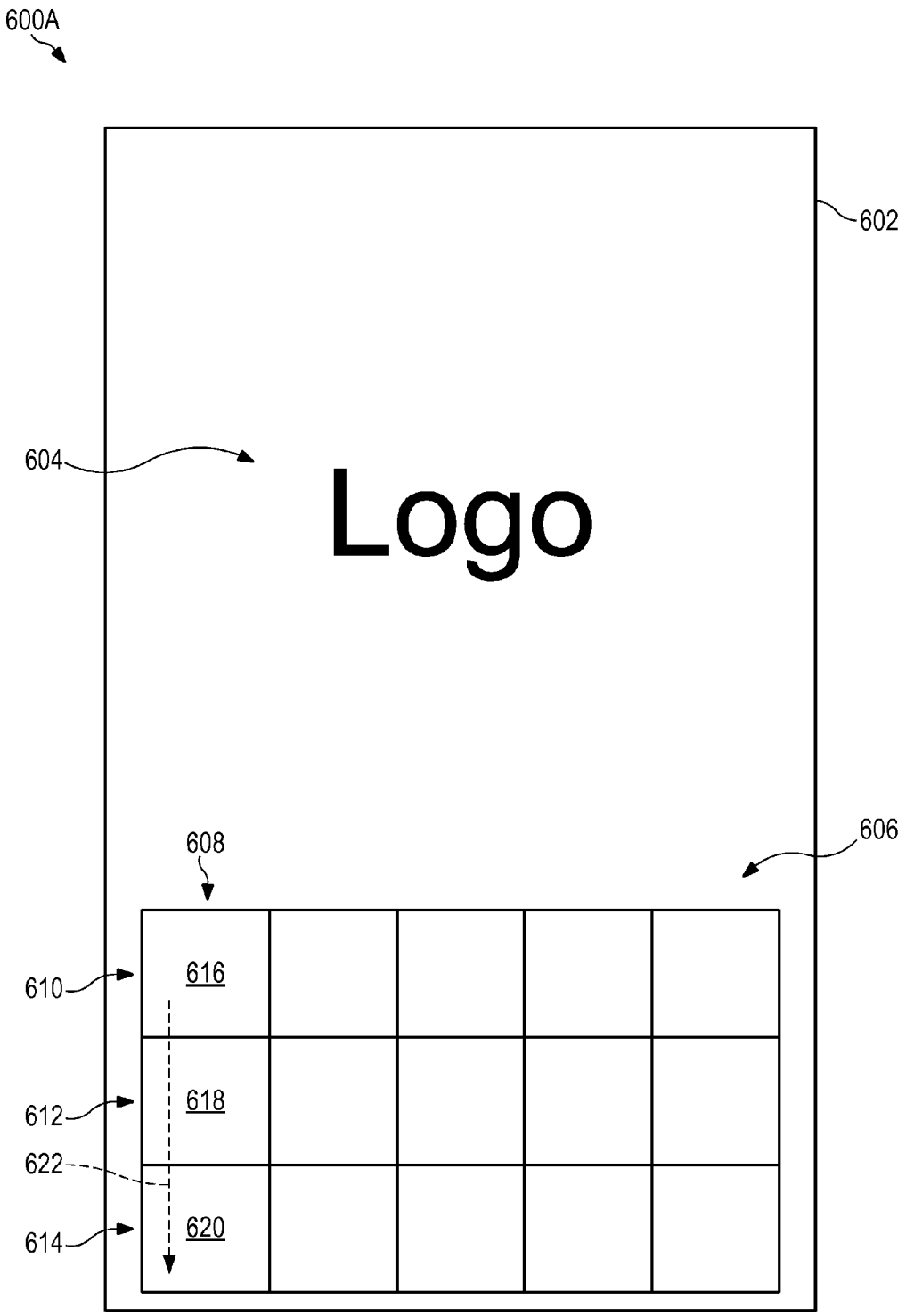
FIG. 6A is another illustration of reel exposing game play on a gaming device, according to one embodiment.

In FIG. 6A, another illustration of reel exposing game play on a gaming device is shown, according to one embodiment. A first reveal game image 600A may include a screen 602, a logo area 604 (and/or a potential revealing area), one or more reels 606, one or more columns 608, and one or more rows. In one example, a first row 610, a second row 612, and a third row 614 are utilized in a base (e.g., non-extended display area, non-extra reveal area, active reel area, etc.) game. The reels and/or columns may spin in a first direction 614. It should be noted that each reel may spin in the same direction either up or down. Further, one or more reels and/or columns and/or rows may spin in a first direction whereas other reels and/or other columns and/or other rows may spin in a second different direction (e.g., first column move up, second column moves down, first row moves left, second row moves right, etc.).

Figure 6B:
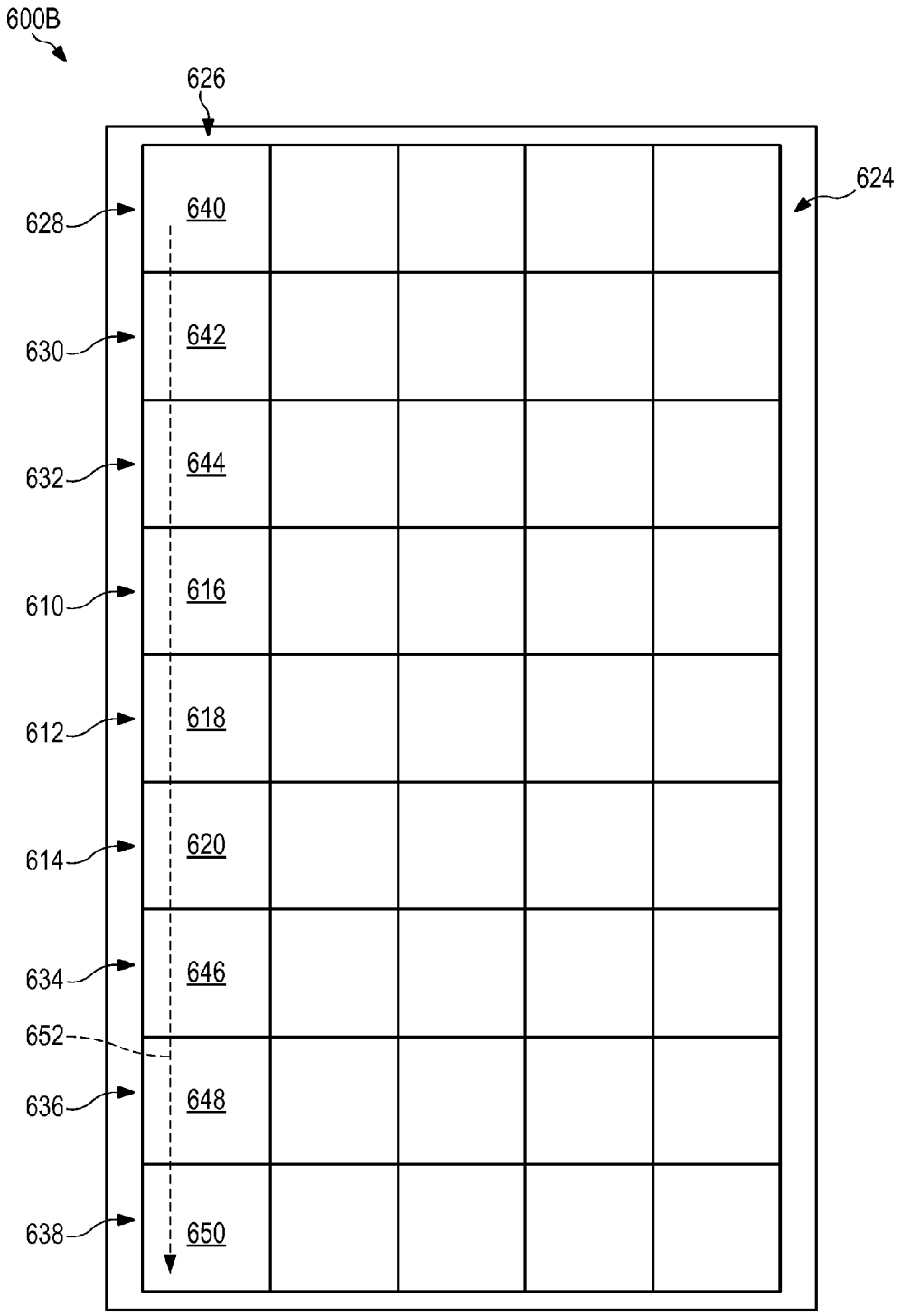
FIG. 6B is another illustration of reel exposing game play on a gaming device, according to one embodiment.

As part of an expanded base game and/or bonus game and/or tournament game, one or more additional columns, reels, and/or rows may be exposed in one or more areas (see FIG. 6B). For example, logo area 604 may be utilized to display a first expanding/revealing row 632 above one or more rows (e.g., first row 610, second row 612, third row 612) displayed as part of the base game. In one example, first expanding/revealing row 632 is not part of the active game play, therefore, no winning paylines may be formed utilized one or more symbols on first expanding/revealing row 632.

In another example, first expanding/revealing row 632 may be part (e.g., integrated into) of the active game play, therefore, winning paylines may be formed utilized one or more symbols on first expanding/revealing row 632. In another example, first expanding/revealing row 632 may not be part of the active game play, but one or more symbols on first expanding/revealing row 632 may drop down into one or more active payline areas.

In another example, logo area 604 may be utilized to display a second expanding/revealing row 630 above one or more rows (e.g., first row 610, second row 612, third row 612) displayed as part of the base game. In this example, second expanding/revealing row 630 is two rows higher than the one or more rows (e.g., first row 610, second row 612, third row 612) displayed as part of the base game. In another example, second expanding/revealing row 630 may be displayed in conjunction with first expanding/revealing row 632. In another example, second expanding/revealing row 630 may be displayed independent of first expanding/revealing row 632 being displayed. In another example, second expanding/revealing row 630 may be displayed depending on whether first expanding/revealing row 632 was displayed.

In one example, second expanding/revealing row 630 is not part of the active game play, therefore, no winning paylines may be formed utilized one or more symbols on second expanding/revealing row 630.

In another example, second expanding/revealing row 630 may be part (e.g., integrated into) of the active game play, therefore, winning paylines may be formed utilized one or more symbols on second expanding/revealing row 630. In another example, second expanding/revealing row 630 may not be part of the active game play, but one or more symbols on second expanding/revealing row 630 may drop down into one or more active payline areas.

In one example, first expanding/revealing row 632 may be part (e.g., integrated into) of the active game play (therefore winning paylines may be formed utilizing one or more symbols on first expanding/revealing row 632) and second expanding/revealing row 630 is not part (e.g., not integrated into the active game play) of the active game play, therefore, no winning paylines may be formed utilized one or more symbols on second expanding/revealing row 630.

In another example, second expanding/revealing row 630 may be part (e.g., integrated into) of the active game play, therefore, winning paylines may be formed utilized one or more symbols on second expanding/revealing row 630 while first expanding/revealing row 632 may not be part (e.g., not integrated into) of the active game play (therefore no winning paylines may be formed utilizing one or more symbols on first expanding/revealing row 632). In another example, second expanding/revealing row 630 may not be part of the active game play, but one or more symbols on second expanding/revealing row 630 may drop down into one or more active payline areas while first expanding/revealing row 632 may not be part of the active game play and does not allow one or more symbols on first expanding/revealing row 632 to drop down into one or more active payline areas.

In another example, logo area 604 may be utilized to display a third expanding/revealing row 628 above one or more rows (e.g., first row 610, second row 612, third row 612) displayed as part of the base game. In this example, third expanding/revealing row 628 is three rows higher than the one or more rows (e.g., first row 610, second row 612, third row 612) displayed as part of the base game. In another example, third expanding/revealing row 628 may be displayed in conjunction with first expanding/revealing row 632 and/or second expanding/revealing row 630. In another example, third expanding/revealing row 628 may be displayed independent of first expanding/revealing row 632 and/or second expanding/revealing row 630. In another example, third expanding/revealing row 628 may be displayed depending on whether first expanding/revealing row 632 was displayed and/or whether second expanding/revealing row 630 was displayed.

In one example, third expanding/revealing row 628 is not part of the active game play, therefore, no winning paylines may be formed utilized one or more symbols on third expanding/revealing row 628.

In another example, third expanding/revealing row 628 may be part of the active game play, therefore, winning paylines may be formed utilized one or more symbols on third expanding/revealing row 628. In another example, third expanding/revealing row 628 may not be part of the active game play, but one or more symbols on third expanding/revealing row 628 may drop down into one or more active payline areas.

In one example, third expanding/revealing row 628 may be part of the active game play (therefore winning paylines may be formed utilizing one or more symbols on third expanding/revealing row 628) and second expanding/revealing row 630 and/or first expanding/revealing row 632 may not be part of the active game play, therefore, no winning paylines may be formed utilized one or more symbols on second expanding/revealing row 630 and/or first expanding/revealing row 632.

In another example, third expanding/revealing row 628 may be part of the active game play, therefore, winning paylines may be formed utilized one or more symbols on third expanding/revealing row 628 while first expanding/revealing row 632 and/or second expanding/revealing row 630 may not be part of the active game play (therefore no winning paylines may be formed utilizing one or more symbols on first expanding/revealing row 632 and/or second expanding/revealing row 630). In another example, third expanding/revealing row 628 may not be part of the active game play, but one or more symbols on third expanding/revealing row 628 may drop down into one or more active payline areas while first expanding/revealing row 632 and/or second expanding/revealing row 630 may not be part of the active game play and does not allow one or more symbols on first expanding/revealing row 632 and/or second expanding/revealing row 630 to drop down into one or more active payline areas.

In another example, a secondary display area may be utilized to display a fourth expanding/revealing row 634 below (and/or to either side of—right and/or left of one or more rows and/or columns) one or more rows (e.g., first row 610, second row 612, third row 612) displayed as part of the base game. In one example, fourth expanding/revealing row 634 is not part of the active game play, therefore, no winning paylines may be formed utilized one or more symbols on fourth expanding/revealing row 634.

In another example, fourth expanding/revealing row 634 may be part of the active game play, therefore, winning paylines may be formed utilized one or more symbols on fourth expanding/revealing row 634. In another example, fourth expanding/revealing row 634 may not be part of the active game play, but one or more symbols on fourth expanding/revealing row 634 may move up into one or more active payline areas.

In another example, secondary area may be utilized to display a fifth expanding/revealing row 636 below one or more rows (e.g., first row 610, second row 612, third row 612) displayed as part of the base game. In this example, fifth expanding/revealing row 636 is two rows lower than the one or more rows (e.g., first row 610, second row 612, third row 612) displayed as part of the base game. In another example, fifth expanding/revealing row 636 may be displayed in conjunction with fourth expanding/revealing row 634. In another example, fifth expanding/revealing row 636 may be displayed independent of fourth expanding/revealing row 634. In another example, fifth expanding/revealing row 636 may be displayed depending on whether fourth expanding/revealing row 634 was displayed.

In one example, fifth expanding/revealing row 636 is not part of the active game play, therefore, no winning paylines may be formed utilized one or more symbols on fifth expanding/revealing row 636.

In another example, fifth expanding/revealing row 636 may be part of the active game play, therefore, winning paylines may be formed utilized one or more symbols on fifth expanding/revealing row 636. In another example, fifth expanding/revealing row 636 may not be part of the active game play, but one or more symbols on fifth expanding/revealing row 636 may move up into one or more active payline areas.

In one example, fourth expanding/revealing row 634 may be part of the active game play (therefore winning paylines may be formed utilizing one or more symbols on fourth expanding/revealing row 634) and fifth expanding/revealing row 636 is not part of the active game play, therefore, no winning paylines may be formed utilized one or more symbols on fifth expanding/revealing row 636.

In another example, fifth expanding/revealing row 636 may be part of the active game play, therefore, winning paylines may be formed utilized one or more symbols on fifth expanding/revealing row 636 while fourth expanding/revealing row 634 may not be part of the active game play (therefore no winning paylines may be formed utilizing one or more symbols on fourth expanding/revealing row 634). In another example, fifth expanding/revealing row 636 may not be part of the active game play, but one or more symbols on fifth expanding/revealing row 636 may move up into one or more active payline areas while fourth expanding/revealing row 634 may not be part of the active game play and does not allow one or more symbols on fourth expanding/revealing row 634 to move up into one or more active payline areas.

In another example, secondary area may be utilized to display a sixth expanding/revealing row 638 below one or more rows (e.g., first row 610, second row 612, third row 612) displayed as part of the base game. In this example, sixth expanding/revealing row 638 is three rows lower than the one or more rows (e.g., first row 610, second row 612, third row 612) displayed as part of the base game. In another example, sixth expanding/revealing row 638 may be displayed in conjunction with fourth expanding/revealing row 634 and/or fifth expanding/revealing row 636. In another example, sixth expanding/revealing row 638 may be displayed independent of fourth expanding/revealing row 634 and/or fifth expanding/revealing row 636 being displayed and/or triggered. In another example, sixth expanding/revealing row 638 may be displayed depending on whether fourth expanding/revealing row 634 was displayed and/or whether fifth expanding/revealing row 636 was displayed.

In one example, sixth expanding/revealing row 638 is not part of the active game play, therefore, no winning paylines may be formed utilized one or more symbols on sixth expanding/revealing row 638.

In another example, sixth expanding/revealing row 638 may be part of the active game play, therefore, winning paylines may be formed utilized one or more symbols on sixth expanding/revealing row 638. In another example, sixth expanding/revealing row 638 may not be part of the active game play, but one or more symbols on sixth expanding/revealing row 638 may move up into one or more active payline areas.

In one example, sixth expanding/revealing row 638 may be part of the active game play (therefore winning paylines may be formed utilizing one or more symbols on sixth expanding/revealing row 638) and fifth expanding/revealing row 636 and/or fourth expanding/revealing row 634 may not be part of the active game play, therefore, no winning paylines may be formed utilized one or more symbols on fifth expanding/revealing row 636 and/or fourth expanding/revealing row 634.

In another example, sixth expanding/revealing row 638 may be part of the active game play, therefore, winning paylines may be formed utilized one or more symbols on sixth expanding/revealing row 638 while fourth expanding/revealing row 634 and/or fifth expanding/revealing row 636 may not be part of the active game play (therefore no winning paylines may be formed utilizing one or more symbols on fourth expanding/revealing row 634 and/or fifth expanding/revealing row 636). In another example, sixth expanding/revealing row 638 may not be part of the active game play, but one or more symbols on sixth expanding/revealing row 638 may move up into one or more active payline areas while fourth expanding/revealing row 634 and/or fifth expanding/revealing row 636 may not be part of the active game play and does not allow one or more symbols on fourth expanding/revealing row 634 and/or fifth expanding/revealing row 636 to move up into one or more active payline areas.

In various examples, all of the expanding/revealing rows may be displayed in conjunction with any other expanding/revealing rows (e.g., first expanding/revealing row 632 and sixth expanding/revealing row 638 are displayed together). In another example, all of the expanding/revealing rows may be displayed independently of any other expanding/revealing rows (e.g., second expanding/revealing row 630, fourth expanding/revealing row 634, and sixth expanding/revealing row 638 are displayed independent of each other and/or any other areas). In another example, sixth expanding/revealing row 638 may be displayed depending on whether fourth expanding/revealing row 634 was displayed and/or whether fifth expanding/revealing row 636 was displayed and/or whether sixth expanding/revealing row 638 was displayed and/or whether fourth expanding/revealing row 634 was not displayed.

Figure 7A:
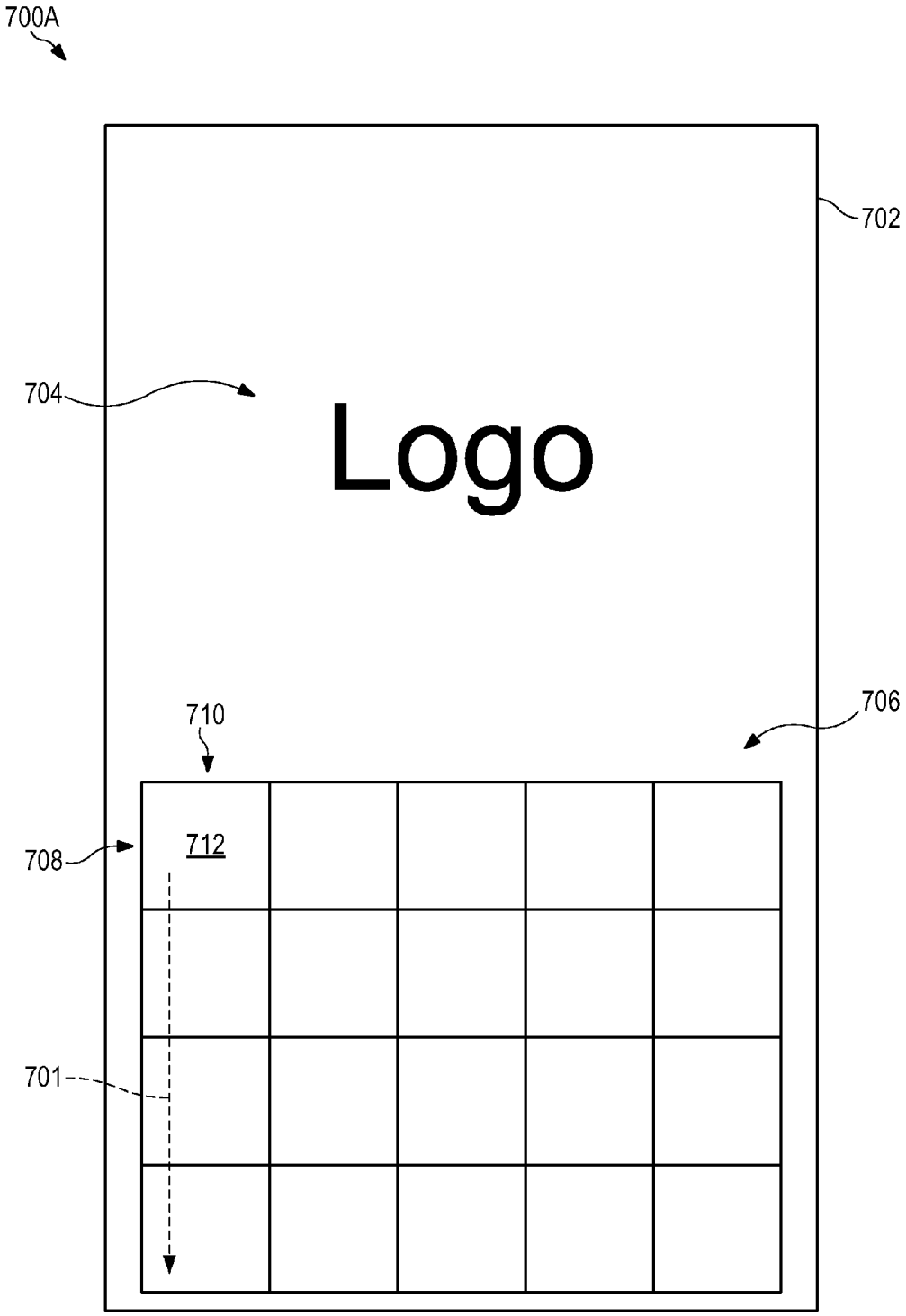
FIG. 7A is another illustration of reel exposing game play on a gaming device, according to one embodiment.

In FIG. 7A, another illustration of reel exposing game play on a gaming device is shown, according to one embodiment. A first revealing area game image 700A may include a display area 702, a logo area 704 (and/or a revealing area), one or more reels 706, one or more rows, and one or more columns. A first row 708 may have a first active space 712 located in a first column 710. Further, one or more reels and/or columns and/or rows may spin in a first direction 701 whereas other reels and/or other columns and/or other rows may spin in a second different direction (e.g., first column move up, second column moves down, first row moves left, second row moves right, etc.).

In one example, the 4 rows by 5 columns matrix is utilized in a base (non-extended display area, non-extra reveal area, active reel area, etc.) game. Therefore, only active paylines in this 4×5 matrix may generate winning combinations.

Figure 7B:
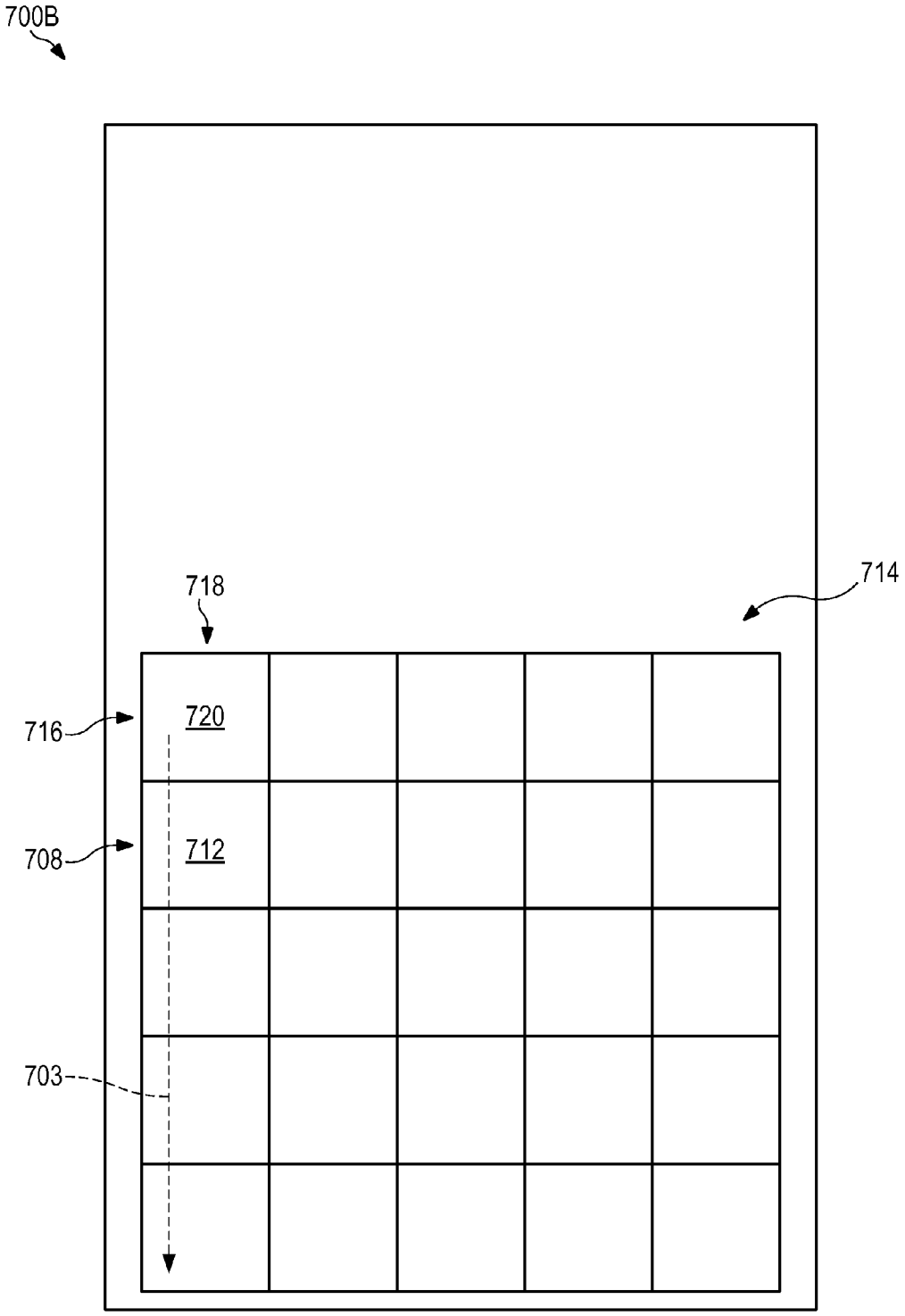
FIG. 7B is another illustration of reel exposing game play on a gaming device, according to one embodiment.

In various examples, one or more revealing areas may be displayed. These one or more revealing areas may vary in length, duration of display, ability to become active reel areas, drop down and/or move up symbol characteristics, active reel area characteristics, static characteristics (e.g., independent elements), and/or dynamic characteristics (e.g., dependent elements). In one example shown in FIG. 7B, a first revealed row 716 has one symbol area in each of the five columns. In this example, first revealed row may generate a new payline, have drop down and/or move up symbols, and/or any characteristics descripted in the FIG. 5 figure set, FIG. 6 figure set, and/or any other description disclosed herein.

Figure 7C:
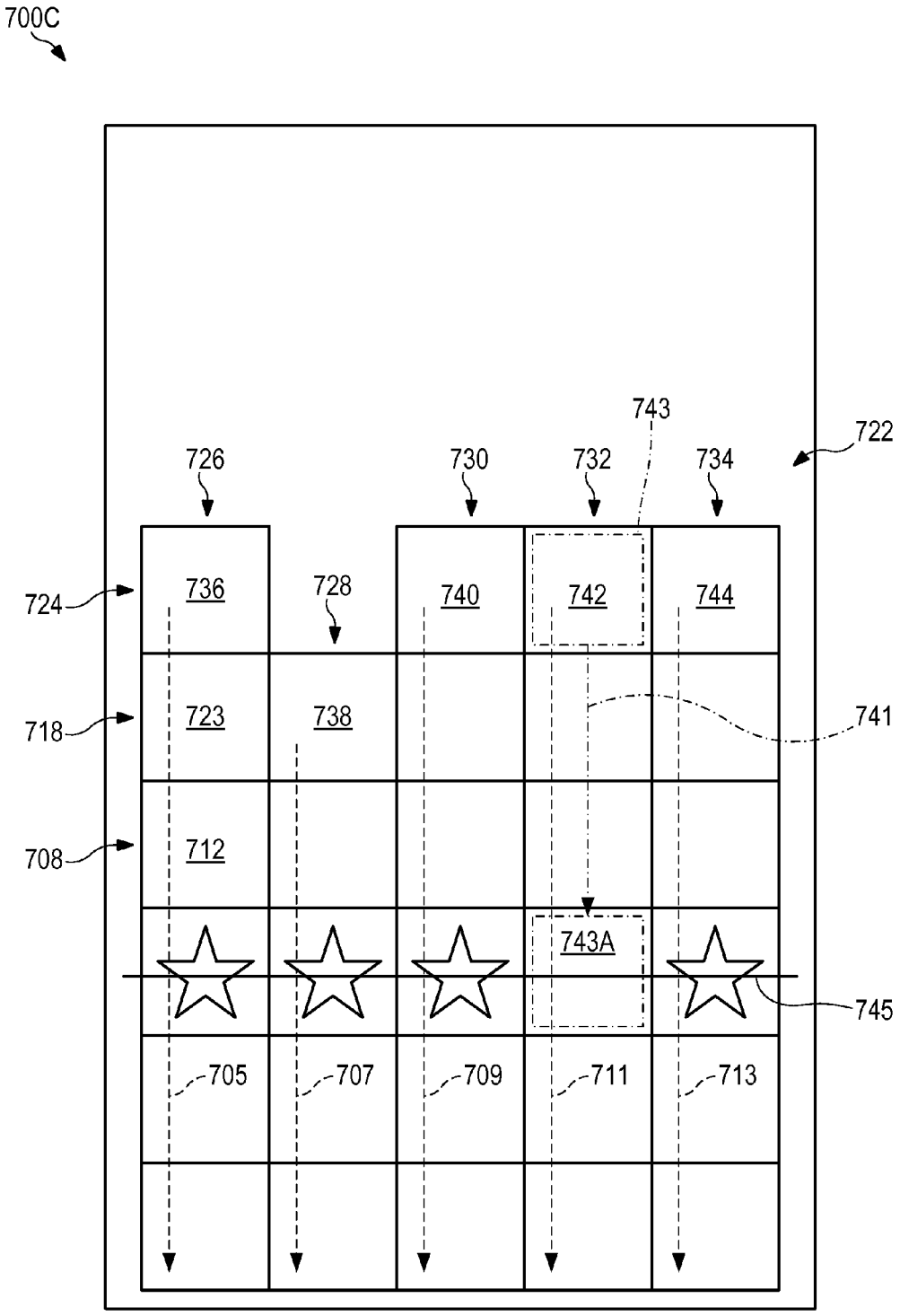
FIG. 7C is another illustration of reel exposing game play on a gaming device, according to one embodiment.

In another example shown in FIG. 7C, a first revealed row 718 and a second revealed row 724 are shown. In this example, first revealed row 718 has one symbol area in each of the five columns. However, second revealed row 724 only has one symbol area in four of the five columns (e.g., column two is missing). In this example, a first reel area 726 (moving in a first direction 705) includes 6 symbol areas where 4 symbols are from the base game and 2 symbols are from the revealing portion of the game play. In this example, a second reel area 728 (moving in a second direction 707) includes 5 symbol areas where 4 symbols are from the base game and 1 symbol is from the revealing portion of the game play. In this example, a third reel area 730 (moving in a third direction 709) includes 6 symbol areas where 4 symbols are from the base game and 2 symbols are from the revealing portion of the game play. In this example, a fourth reel area 732 (moving in a fourth direction 711) includes 6 symbol areas where 4 symbols are from the base game and 2 symbols are from the revealing portion of the game play. In this example, a fifth reel area 734 (moving in a fifth direction 713) includes 6 symbol areas where 4 symbols are from the base game and 2 symbols are from the revealing portion of the game play. In this example, all of the revealed areas are occurring in a secondary display area 722. Further, first direction 705, second direction 707, third direction 709, fourth direction 711, and fifth direction 713 may move in the same direction, different directions, and/or any combination thereof. In addition, a first revealed area 722, a second revealed area 736, a third revealed area 738, a fourth revealed area 740, a fifth revealed area 742, and/or a sixth revealed area 744 may be utilized to form a winning payline (or a portion thereof—for example one area from fourth revealed area 740—or a portion from fifth revealed area 742 and sixth revealed area 744), may not be utilized to form a winning payline, may be utilized for a drop down and/or move up symbol, may not be utilized for a drop down and/or move up symbol, may be utilized for a special collection area, may not be utilized for a special collection area, may be utilized for a special symbol activation, may not be utilized for a special symbol activation, may be utilized for a symbol activation, may not be utilized for a symbol activation, and/or any combination thereof.

In another example, fifth revealed area 742 may have a first symbol 743 (e.g. a wild) which may be dropped down into one or more active reel areas. In this example, first symbol 743 is moved into a first symbol active area 743A to form a first winning combination 745.

Figure 7D:
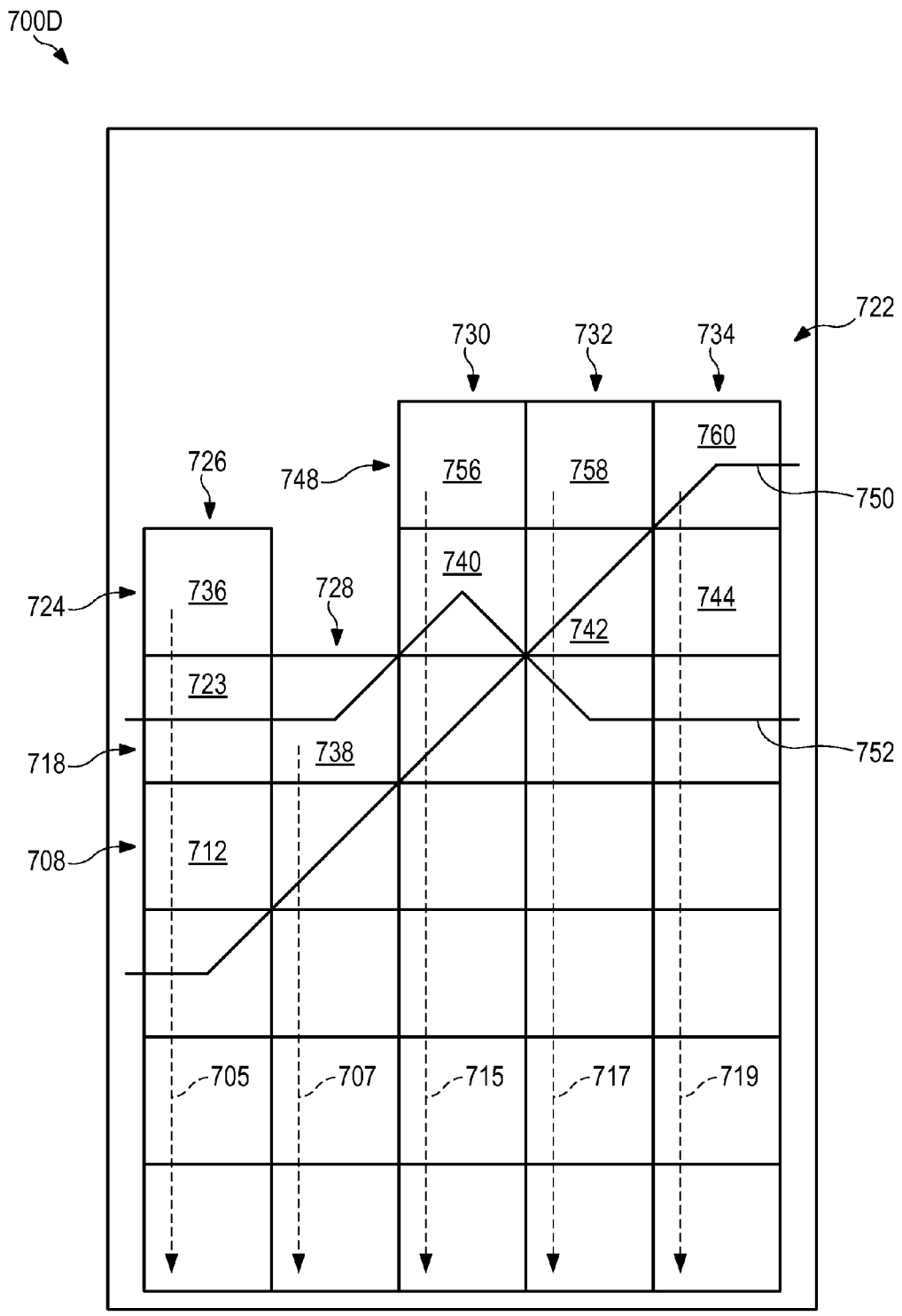
FIG. 7D is another illustration of reel exposing game play on a gaming device, according to one embodiment.

In another example shown in FIG. 7D, first revealed row 718, second revealed row 724, and a third revealed row 748 are shown. In this example, first revealed row 718 has one symbol area in each of the five columns. However, second revealed row 724 only has one symbol area in four of the five columns (e.g., column two is missing). Further, third revealed row 748 only has one symbol area in three of the five columns. In this example, first reel area 726 (moving in first direction 705) includes 6 symbol areas where 4 symbols are from the base game and 2 symbols are from the revealing portion of the game play. In this example, second reel area 728 (moving in second direction 707) includes 5 symbol areas where 4 symbols are from the base game and 1 symbol is from the revealing portion of the game play. In this example, third reel area 730 (moving in third direction 709) includes 7 symbol areas where 4 symbols are from the base game and 3 symbols are from the revealing portion of the game play. In this example, fourth reel area 732 (moving in fourth direction 711) includes 7 symbol areas where 4 symbols are from the base game and 3 symbols are from the revealing portion of the game play. In this example, fifth reel area 734 (moving in fifth direction 713) includes 7 symbol areas where 4 symbols are from the base game and 3 symbols are from the revealing portion of the game play. In this example, all of the revealed areas are occurring in a secondary display area 722. Further, the revealed areas may be displayed at the same time, in a fading in and/or a fading out pattern, building on each other—the player see the first revealed area then the second revealed area, etc., and/or any pattern and/or any combination thereof.

In another example, a first payline 750 may be formed by one or more active areas within the revealed area and one or more areas within the base game. Further, a second payline 752 may be formed by one or more active areas within the revealed area.

Figure 7E:
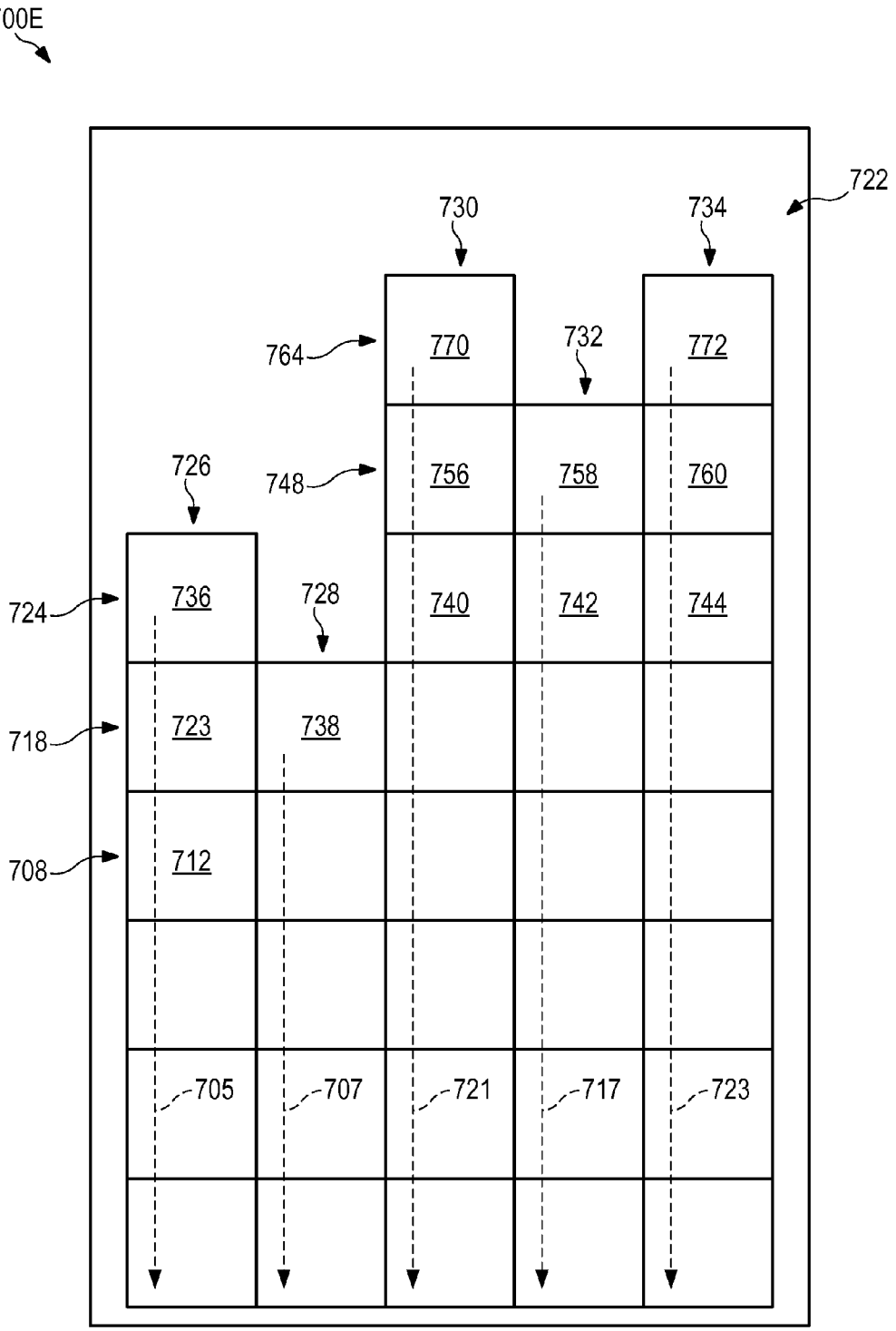
FIG. 7E is another illustration of reel exposing game play on a gaming device, according to one embodiment.

In another example shown in FIG. 7E, first revealed row 718, second revealed row 724, third revealed row 748, and a fourth revealed row 764 are shown. In this example, first revealed row 718 has one symbol area in each of the five columns. However, second revealed row 724 only has one symbol area in four of the five columns (e.g., column two is missing). Further, third revealed row 748 only has one symbol area in three of the five columns (e.g., columns one and two are missing). In addition, fourth revealed row 764 only has one symbol area in two of the five columns (e.g., columns one, two, and four are missing). In this example, first reel area 726 (moving in first direction 705) includes 6 symbol areas where 4 symbols are from the base game and 2 symbols are from the revealing portion of the game play. In this example, second reel area 728 (moving in second direction 707) includes 5 symbol areas where 4 symbols are from the base game and 1 symbol is from the revealing portion of the game play. In this example, third reel area 730 (moving in third direction 709) includes 8 symbol areas where 4 symbols are from the base game and 4 symbols are from the revealing portion of the game play. In this example, fourth reel area 732 (moving in fourth direction 711) includes 7 symbol areas where 4 symbols are from the base game and 3 symbols are from the revealing portion of the game play. In this example, fifth reel area 734 (moving in fifth direction 713) includes 8 symbol areas where 4 symbols are from the base game and 4 symbols are from the revealing portion of the game play. In this example, all of the revealed areas are occurring in a secondary display area 722. These revealed areas may be displayed simultaneously, may be dependent on an ante bet, may be dependent on one or more symbols being displayed to trigger one or more revealed areas, may be displayed in different colors from each other, may be displayed differently than the base game, may be dependent on a maximum bet being made, and/or any combination thereof.

Figure 7F:
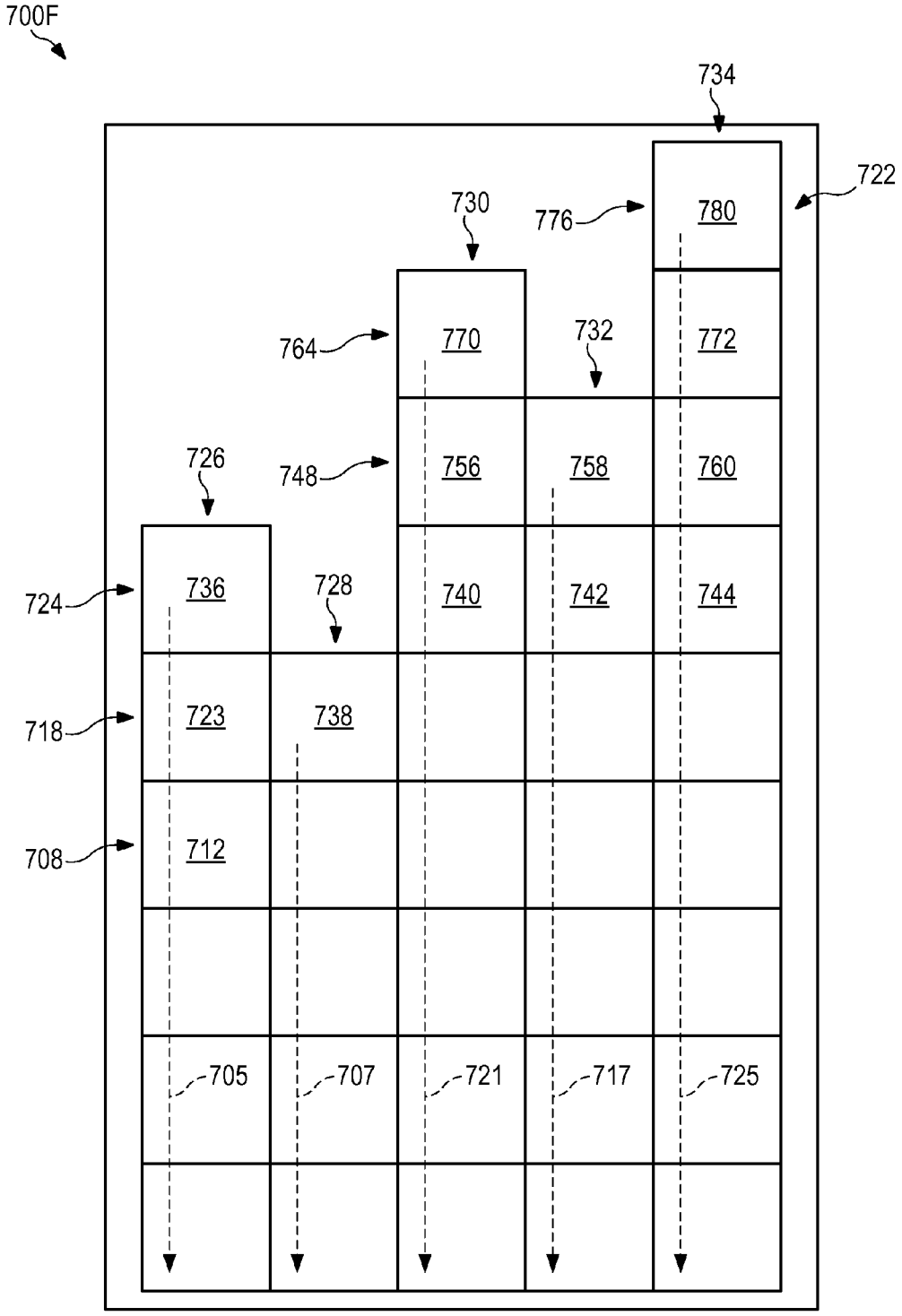
FIG. 7F is another illustration of reel exposing game play on a gaming device, according to one embodiment.

In another example shown in FIG. 7F, first revealed row 718, second revealed row 724, third revealed row 748, fourth revealed row 764, and a fifth revealed row 776 are shown. In this example, first revealed row 718 has one symbol area in each of the five columns. However, second revealed row 724 only has one symbol area in four of the five columns (e.g., column two is missing). Further, third revealed row 748 only has one symbol area in three of the five columns (e.g., columns one and two are missing). In addition, fourth revealed row 764 only has one symbol area in two of the five columns (e.g., columns one, two, and four are missing). Further, fifth revealed row 776 only has one symbol area in one of the five columns (e.g., columns one, two, three, and four are missing). In this example, first reel area 726 (moving in first direction 705) includes 6 symbol areas where 4 symbols are from the base game and 2 symbols are from the revealing portion of the game play. In this example, second reel area 728 (moving in second direction 707) includes 5 symbol areas where 4 symbols are from the base game and 1 symbol is from the revealing portion of the game play. In this example, third reel area 730 (moving in third direction 709) includes 8 symbol areas where 4 symbols are from the base game and 4 symbols are from the revealing portion of the game play. In this example, fourth reel area 732 (moving in fourth direction 711) includes 7 symbol areas where 4 symbols are from the base game and 3 symbols are from the revealing portion of the game play. In this example, fifth reel area 734 (moving in fifth direction 713) includes 9 symbol areas where 4 symbols are from the base game and 5 symbols are from the revealing portion of the game play. In this example, all of the revealed areas are occurring in a secondary display area 722. These revealed areas may be displayed simultaneously, may be dependent on an ante bet, may be dependent on one or more symbols being displayed to trigger one or more revealed areas, may be displayed in different colors from each other, may be displayed differently than the base game, may be dependent on a maximum bet being made, and/or any combination thereof. In various examples, the base game may be displayed in a first format (e.g., font, color, symbol characteristics, etc.) and the revealing game portion may be displayed in a second format (e.g., a second font, a second color scheme, a second symbol characteristic, etc.). In one example, a pirate may have a sword in the base game but a bow in the revealing game portion. In another example, a symbol in the revealed area may be blue but the symbol turns green in the base game area.

Figure 7G:
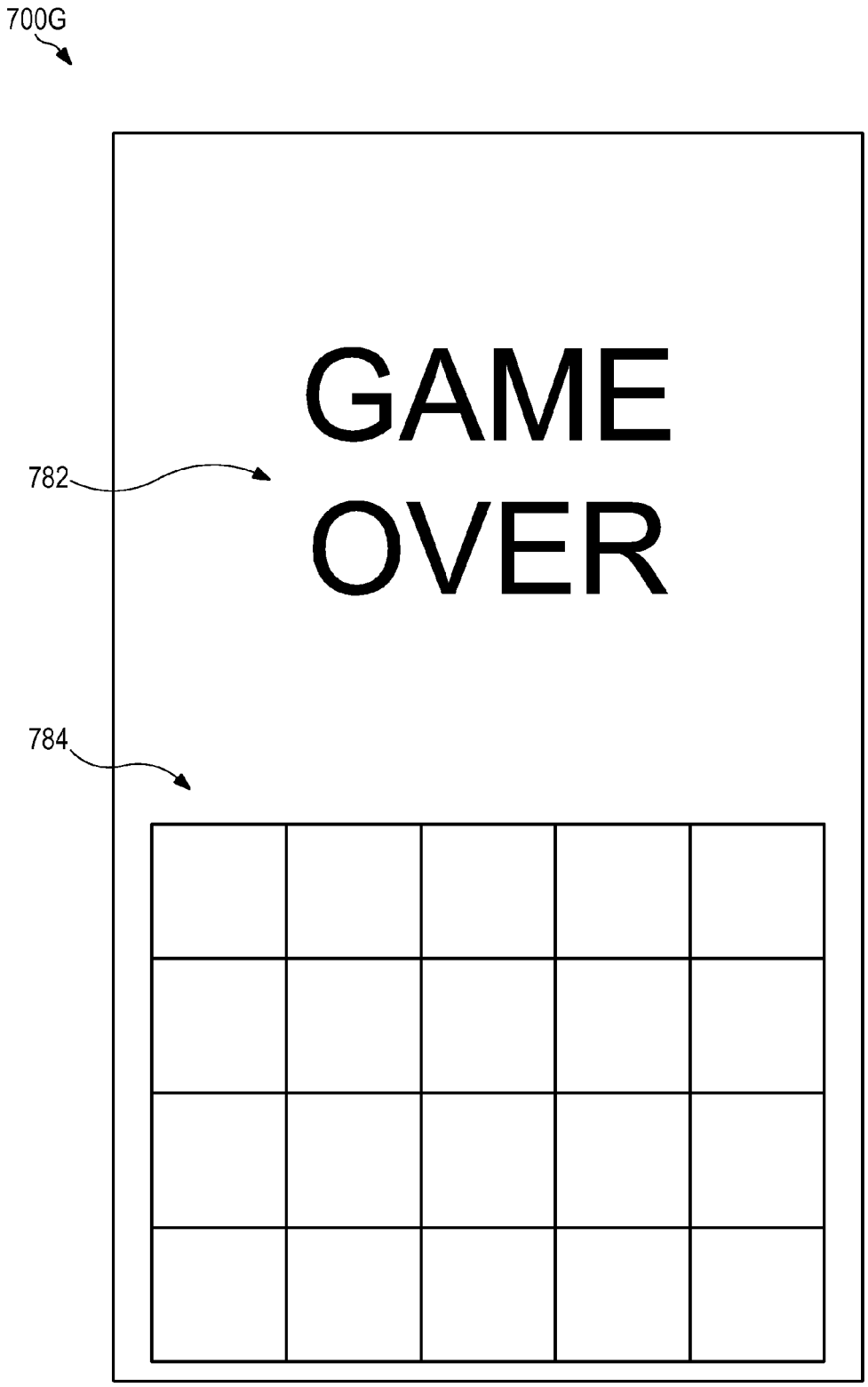
FIG. 7G is another illustration of reel exposing game play on a gaming device, according to one embodiment.

In one example, when the game ends one or more of the revealed areas is no longer displayed. In this example, an end game message 782 may be displayed and the base game may be the only symbols displayed in base game display area 784. The revealed areas may disappear in a fading out manner, in a step pattern, all at once, and/or any other method (see FIG. 7G).

Figure 8A:
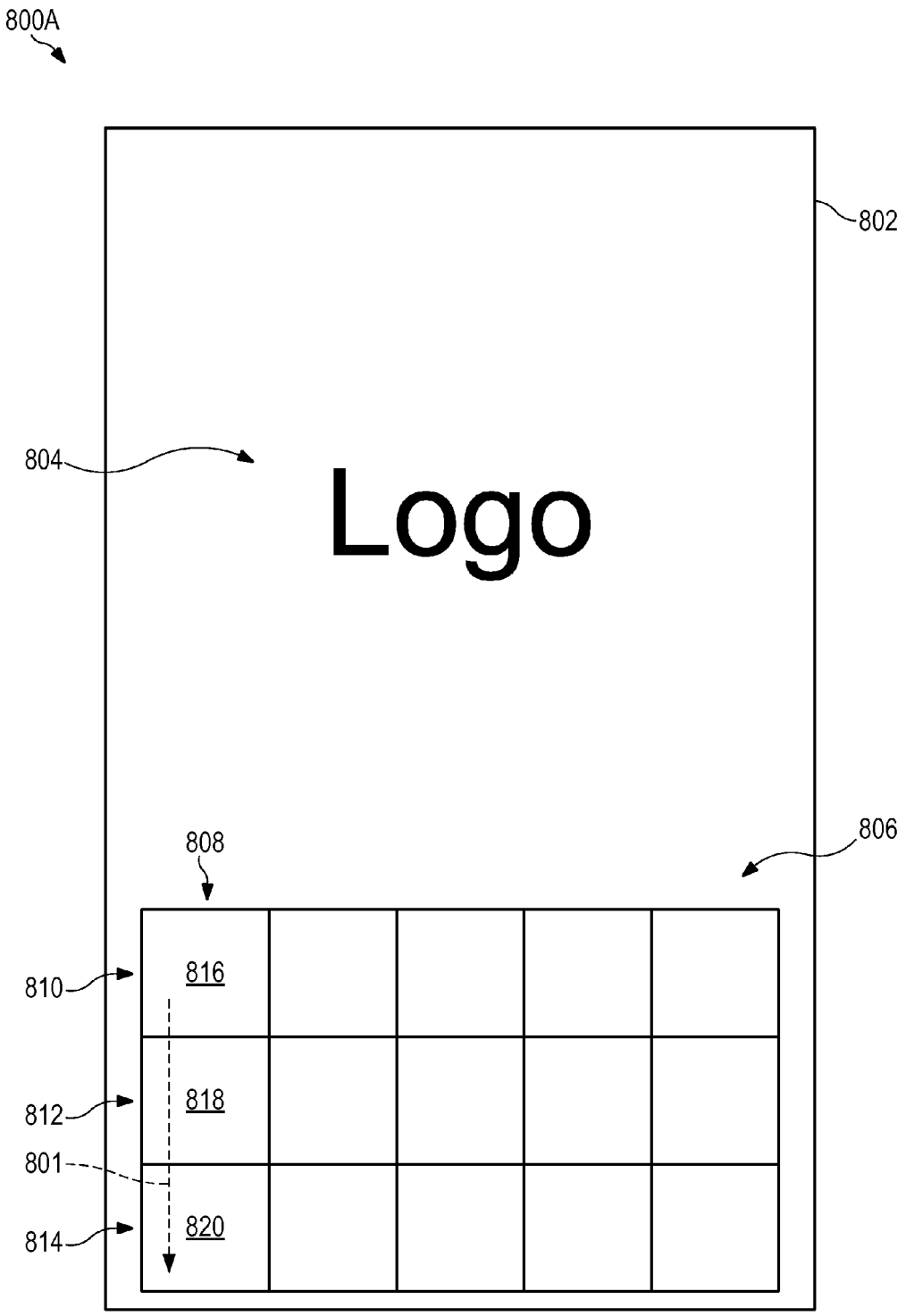
FIG. 8A is another illustration of reel exposing game play on a gaming device, according to one embodiment.
Figure 8B:
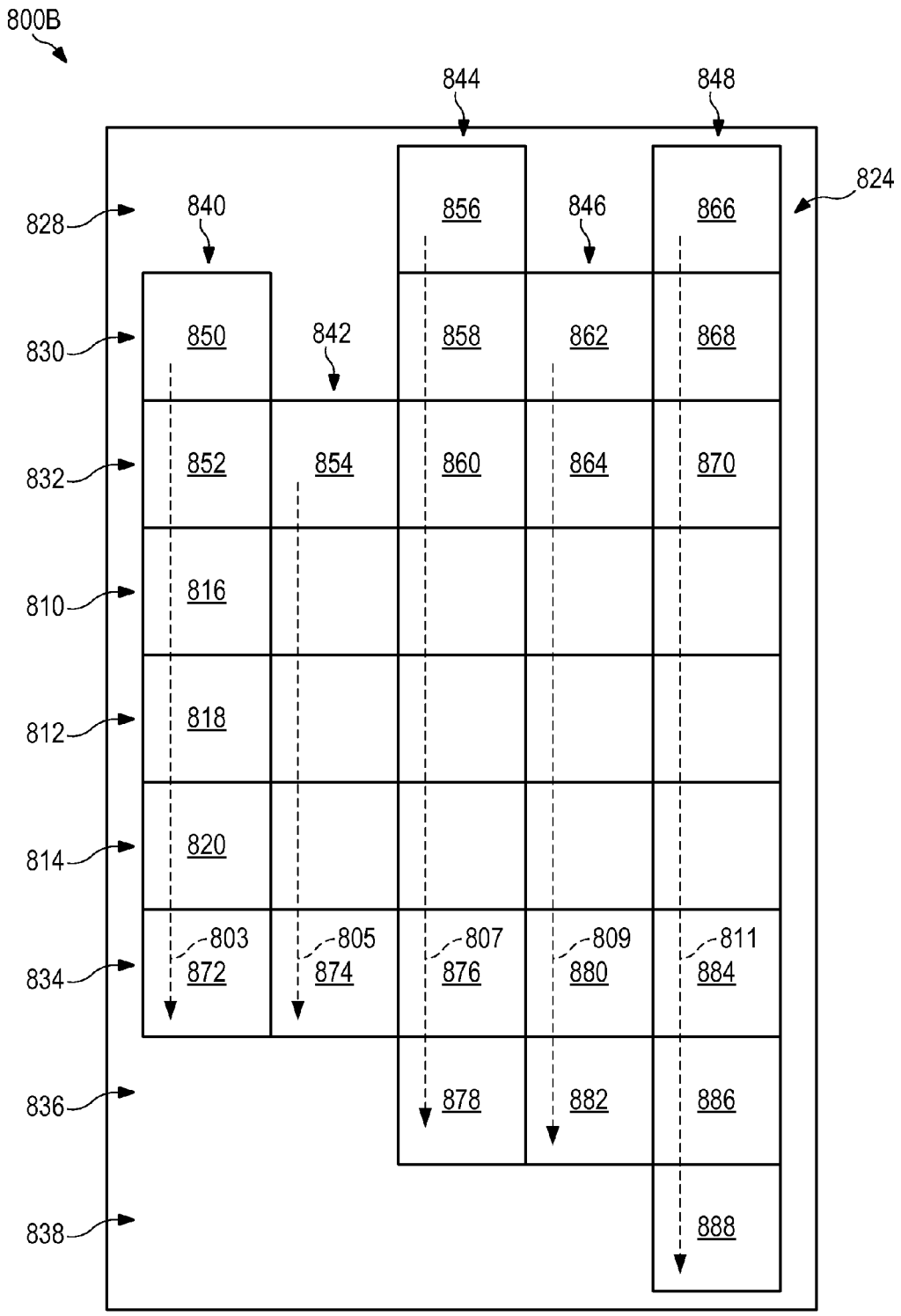
FIG. 8B is another illustration of reel exposing game play on a gaming device, according to one embodiment.

In one example shown in FIG. 8A, a base game area 806 with one or more rows (e.g., a first row 810, a second row 812, a third row 814, etc.) and one or more columns 808 is displayed on a portion of display area 802. In one example shown in FIG. 8B, a first revealed row 832 is displayed above (e.g., one level above) the base game, a second revealed row 834 is displayed below (e.g., one level below) the base game, a third revealed row 830 is displayed above (e.g., two levels above) the base game, a fourth revealed row 836 is displayed below (e.g., two levels below) the base game, a fifth revealed row 828 is displayed above (e.g., three levels above) the base game, and a sixth revealed row 838 is displayed below (e.g., three levels below) the base game.

In this example, first revealed row 832 and second revealed row 834 have one symbol area in each of the five columns. Third revealed row 830 has one symbol area in 4 of the 5 columns (e.g., column 2 is missing). Fourth revealed row 836 has one symbol area in 3 of the 5 columns (e.g., columns 1 and 2 are missing). Fifth revealed row 828 has one symbol area in 2 of the 5 columns (e.g., columns 1, 2, and 4 are missing). Sixth revealed row 838 has one symbol area in 1 of the 5 columns (e.g., columns 1-4 are missing).

In this example, a first reel area 840 (moving in a first direction 803) includes 6 symbol areas where 3 symbols are from the base game and 3 symbols are from the revealing portion of the game play (two symbols in the revealed portion are above the base game and one symbol in the revealed portion is below the base game). In this example, a second reel area 842 (moving in a second direction 805) includes 5 symbol areas where 3 symbols are from the base game and 2 symbols are from the revealing portion of the game play (one symbol in the revealed portion is above the base game and one symbol in the revealing portion is below the base game). In this example, a third reel area 844 (moving in a third direction 807) includes 8 symbol areas where 3 symbols are from the base game and 5 symbols are from the revealing portion of the game play (two symbols in the revealed portion are above the base game and three symbols in the revealed portion are below the base game. In this example, a fourth reel area 846 (moving in a fourth direction 809) includes 7 symbol areas where 3 symbols are from the base game and 4 symbols are from the revealing portion of the game play (two symbols are from the revealed area are above the base game and two symbols are from the revealed area are below the base game). In this example, fifth reel area 734 (moving in fifth direction 713) includes 9 symbol areas where 3 symbols are from the base game and 6 symbols are from the revealing portion of the game play (where three symbols are from the revealed area are above the base game and three symbols are from the revealed area are below the base game). In this example, all of the revealed areas are occurring in a secondary display area 824.

Figure 9A:
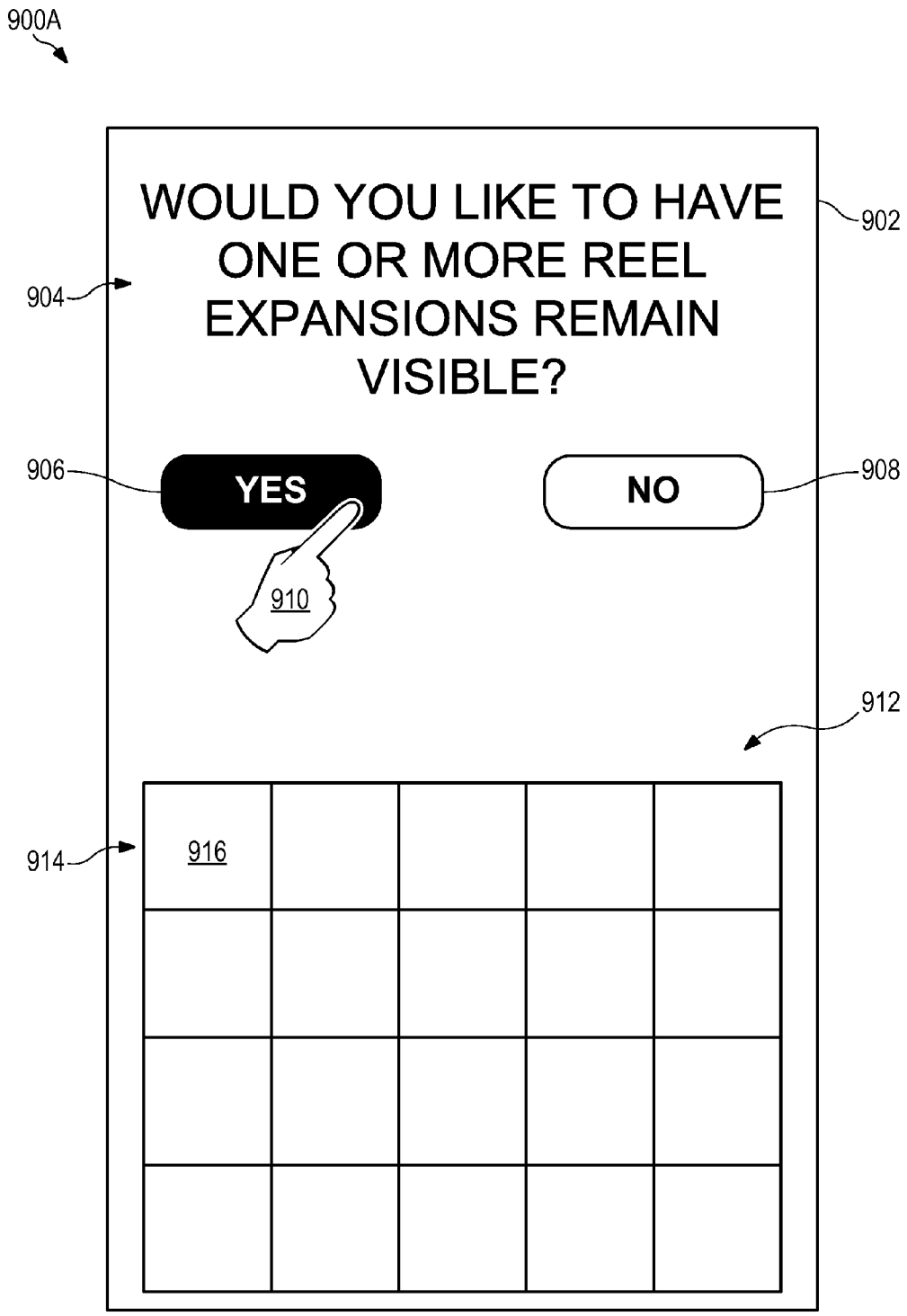
FIG. 9A is another illustration of reel exposing game play on a gaming device, according to one embodiment.

In FIG. 9A, another illustration of reel exposing game play on a gaming device is shown, according to one embodiment. In this example, a player may elect to have one or more revealing areas/expansion areas remain visible and/or active. A message area may state "WOULD YOU LIKE TO HAVE ONE OR MORE REEL EXPANSION REMAIN VISIBLE?" The player may select a first option 906 (e.g., Yes) or a second option 908 (e.g., No) via a hand image 910 (and/or any other input method). This option may require an ante bet, a maximum bet, be part of a bonus, and/or be dependent on any other game characteristic.

Figure 9B:
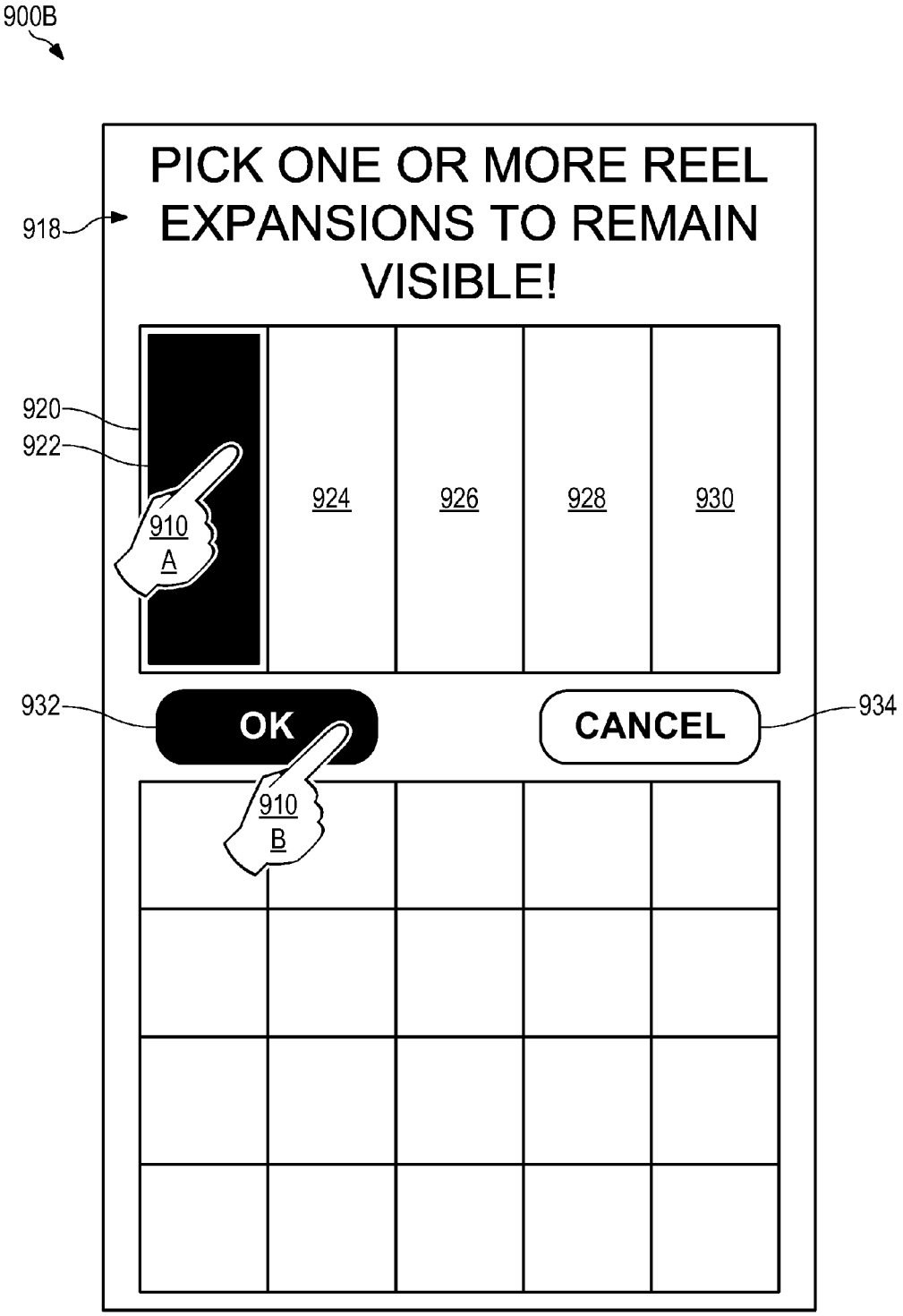
FIG. 9B is another illustration of reel exposing game play on a gaming device, according to one embodiment.

If the player elects to have one or more areas remain visible, then a first selection option 922, a second selection option 924, a third selection option 926, a fourth selection option 928, a fifth selection option 930, and an Nth selection option (not shown) may be displayed. In this example, the player has elected to keep first selection option 922 visible and/or active during game play. First selection option 922 may be highlighted to indicate that it has been selected and may be confirmed by a confirmation button 932 or canceled via a cancel button 934 (see FIG. 9B).

Figure 9C:
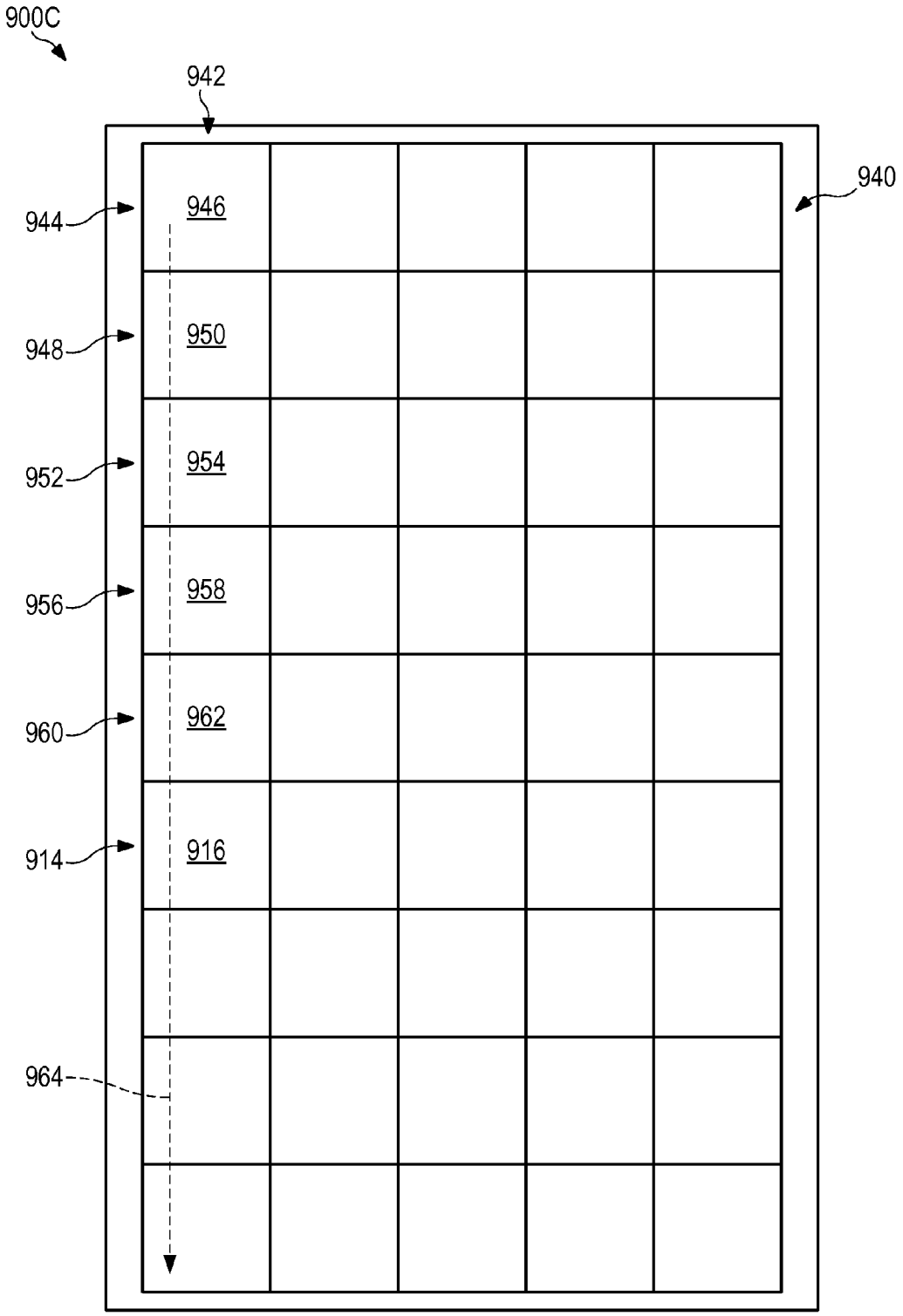
FIG. 9C is another illustration of reel exposing game play on a gaming device, according to one embodiment.
Figure 9D:
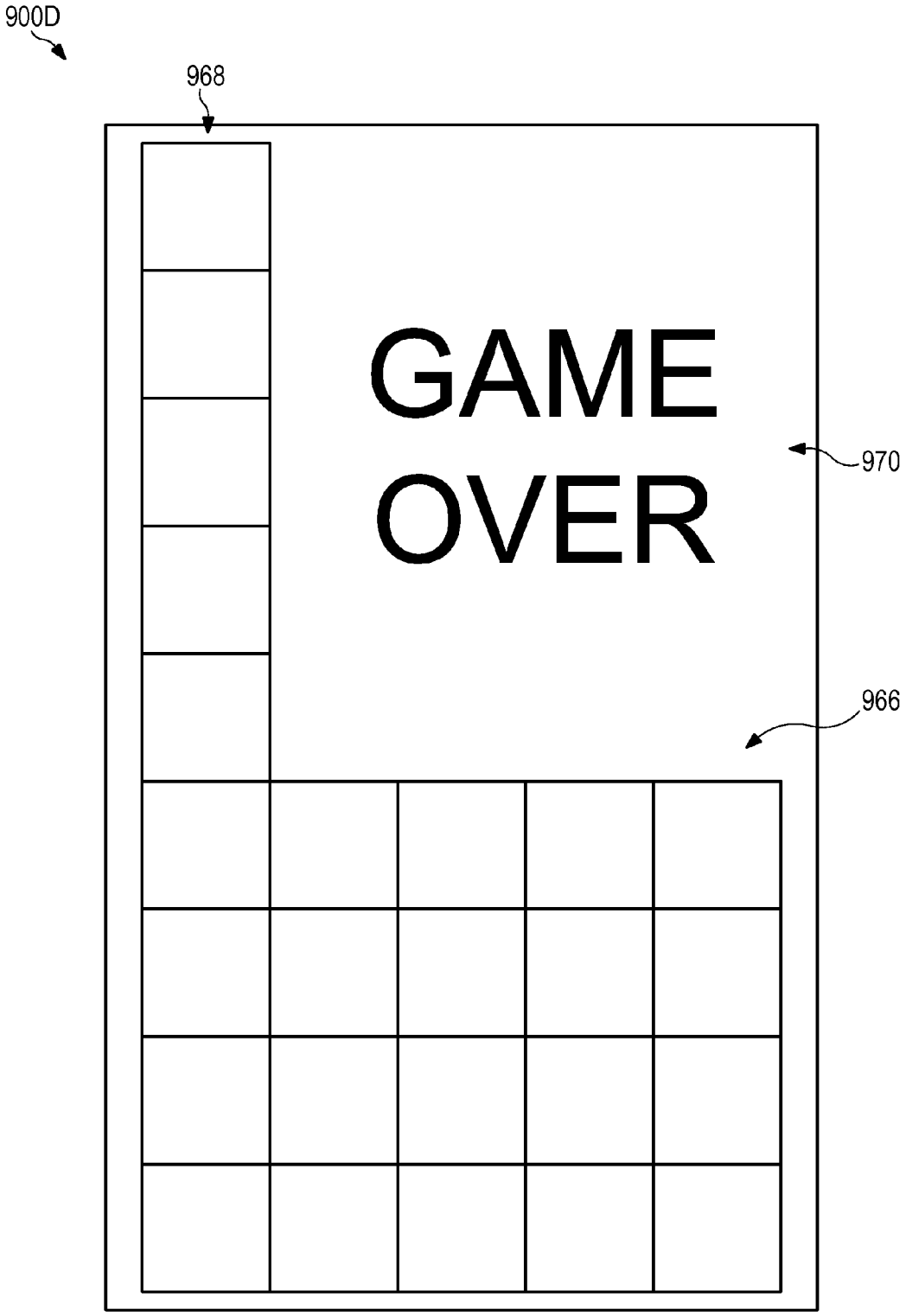
FIG. 9D is another illustration of reel exposing game play on a gaming device, according to one embodiment.

During game play as seen in FIG. 9C, a first revealed row 960, a second revealed row 956, a third revealed row 952, a fourth revealed row 948, and a fifth revealed row 944 may be displayed. However, once game play has ended normally all of the revealed areas (e.g., first revealed row 960, second revealed row 956, third revealed row 952, fourth revealed row 948, and fifth revealed row 944) would be hidden. However, since the player has elected to have first selection option 922 remain visible, then a remain revealed area 968 is shown at the end of game play (see FIG. 9D).

In one example, there may be no revealing areas on the next spin (because no maximum bet was made, no ante bet was made, normal game play feature, etc.) but the selected remain revealed area would still remain revealed and/or active. In this example, this revealed area may still generate one or more winning combinations, drop down symbols, move up symbols, special payouts based on one or more symbols stopping in the revealed area, and/or any combination thereof.

Figure 10:
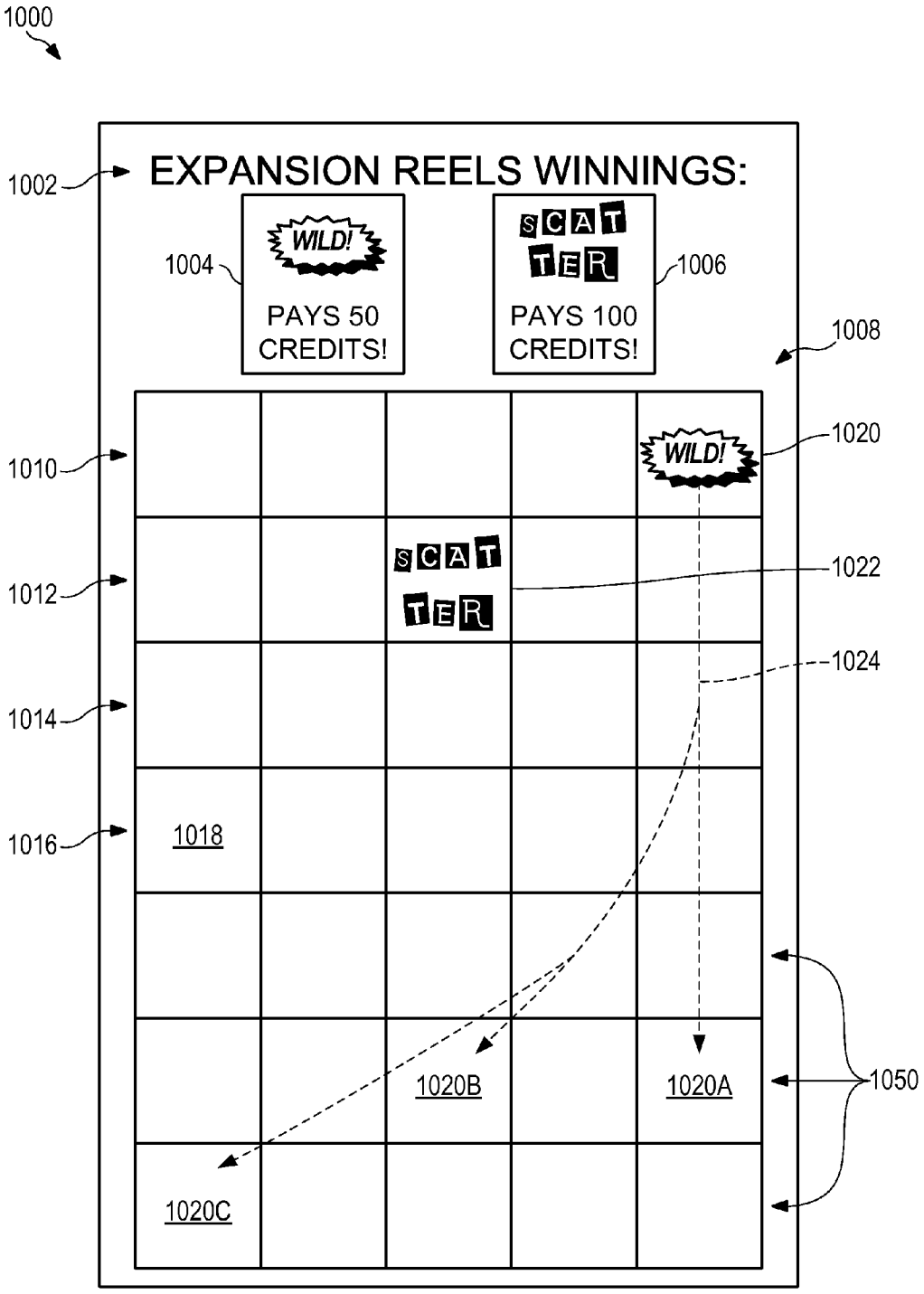
FIG. 10 is another illustration of reel exposing game play on a gaming device, according to one embodiment.

In FIG. 10, another illustration of reel exposing game play on a gaming device is shown, according to one embodiment. In this example, one or more symbols are generated on one or more revealed areas which generates one or more prizes. For example, a first scatter symbol 1022 stops on a third revealed row 1012 which generates a first payout 1006 (e.g., 100 credits, 2× multiplier, extended revealing game time, free spins, a revealed area selection to keep one or more revealed areas active and/or displayed, a collection area game, a drop down and/or move up symbol option, and/or any combination thereof). In another example, a first wild symbol 1020 stops on a fourth revealed row 1010 which may generate a second payout 1004 and/or first wild symbol 1020 may drop down in the active reel area (e.g., a first spot 1020A, a second spot 1020B, and/or a third spot 1020C) to generate one or more winning combinations. Further, this may be a super exposing reel game feature.

Figure 11:
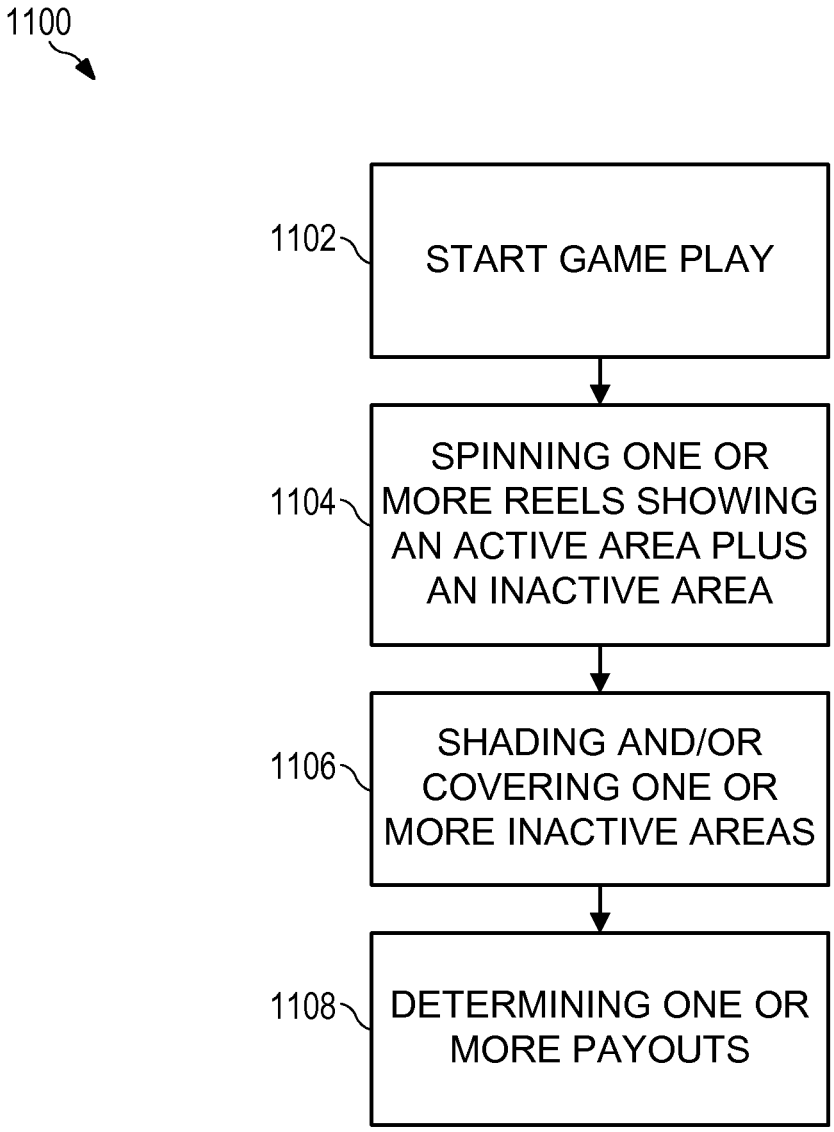
FIG. 11 is a game play flow diagram, according to one embodiment.

In FIG. 11, a game play flow diagram 1100 is shown, according to one embodiment. The method may include starting game play (step 1102). The method may include spinning one or more reels showing an active area plus an inactive area (step 1104). The method may include shading and/or covering one or more inactive areas (step 1106). The method may include determining one or more payouts (step 1108).

Figure 12:
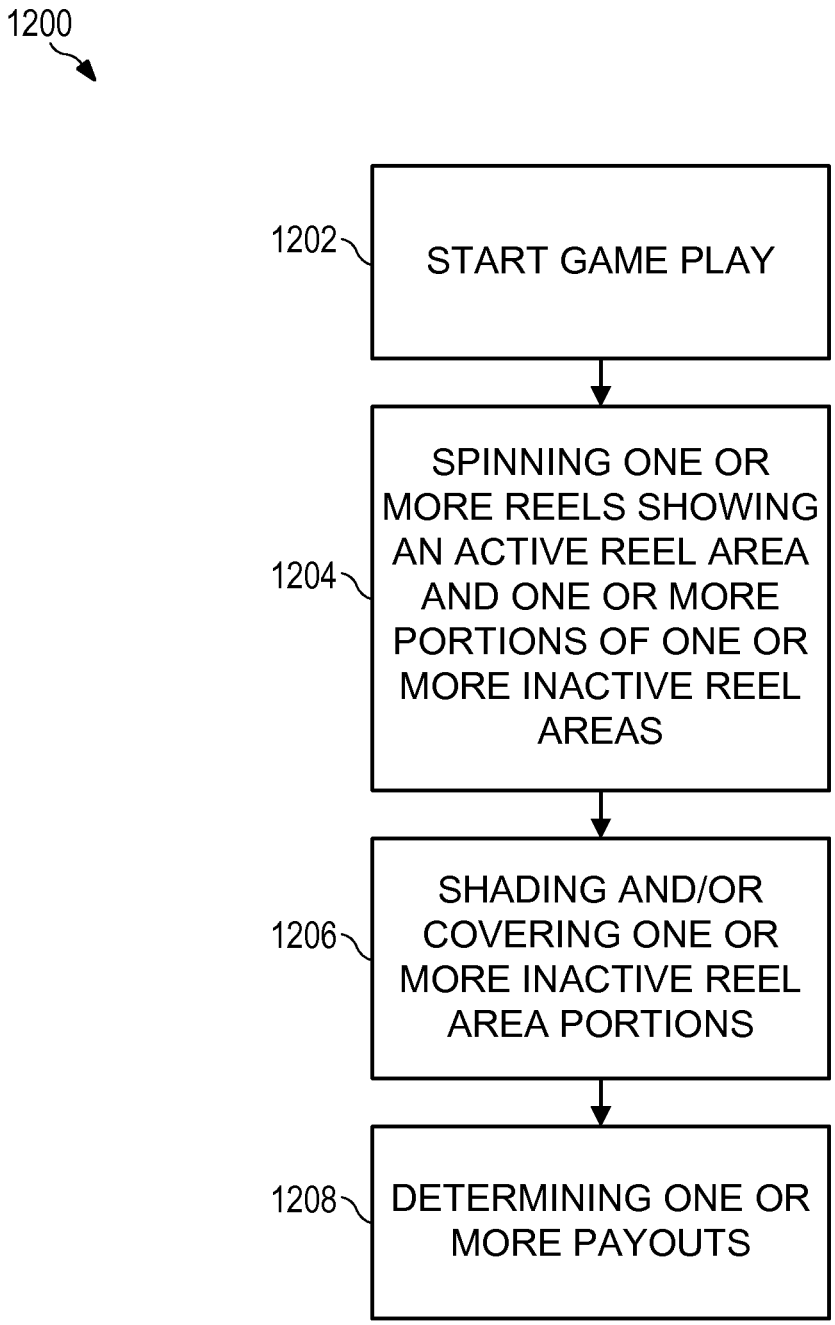
FIG. 12 is a flow diagram for game play, according to one embodiment.

In FIG. 12, a flow diagram for game play 1200 is shown, according to one embodiment. The method may include starting game play (step 1202). The method may include spinning one or more reels showing an active reel area and one or more portions of one or more inactive reel areas (step 1204). The method may include shading and/or covering one or more inactive reel area portions (step 1206). The method may include determining one or more payouts (step 1208).

Figure 13:
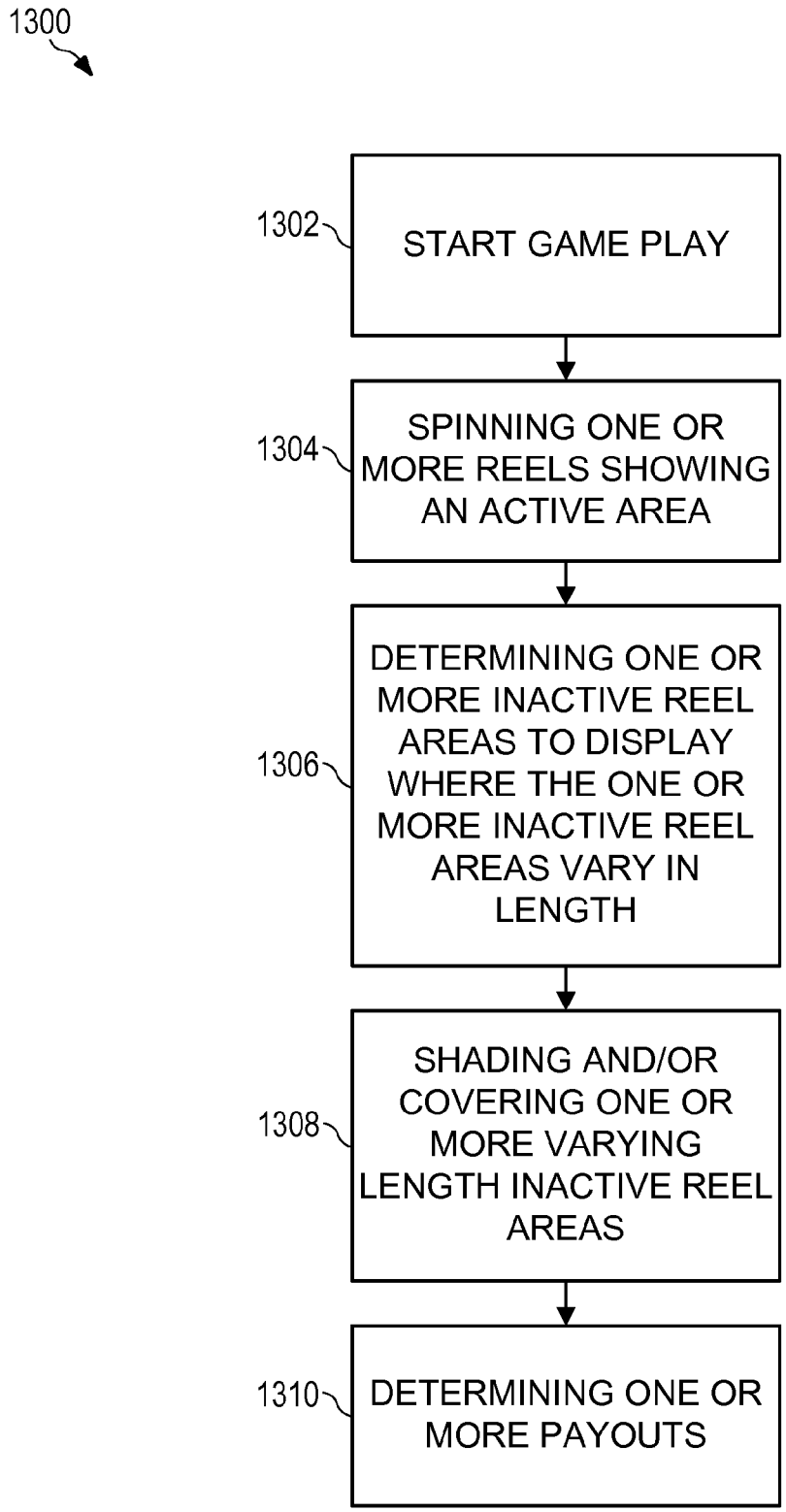
FIG. 13 is a flow diagram for game play, according to one embodiment.

In FIG. 13, a flow diagram for game play 1300 is shown, according to one embodiment. The method may include starting game play (step 1302). The method may include spinning one or more reels showing an active area (step 1304). The method may include determining one or more inactive reel areas to display where the one or more inactive reel areas vary in length (step 1306). The method may include shading and/or covering one or more varying length inactive reel areas (step 1308). The method may include determining one or more payouts (step 1310).

Figure 14:
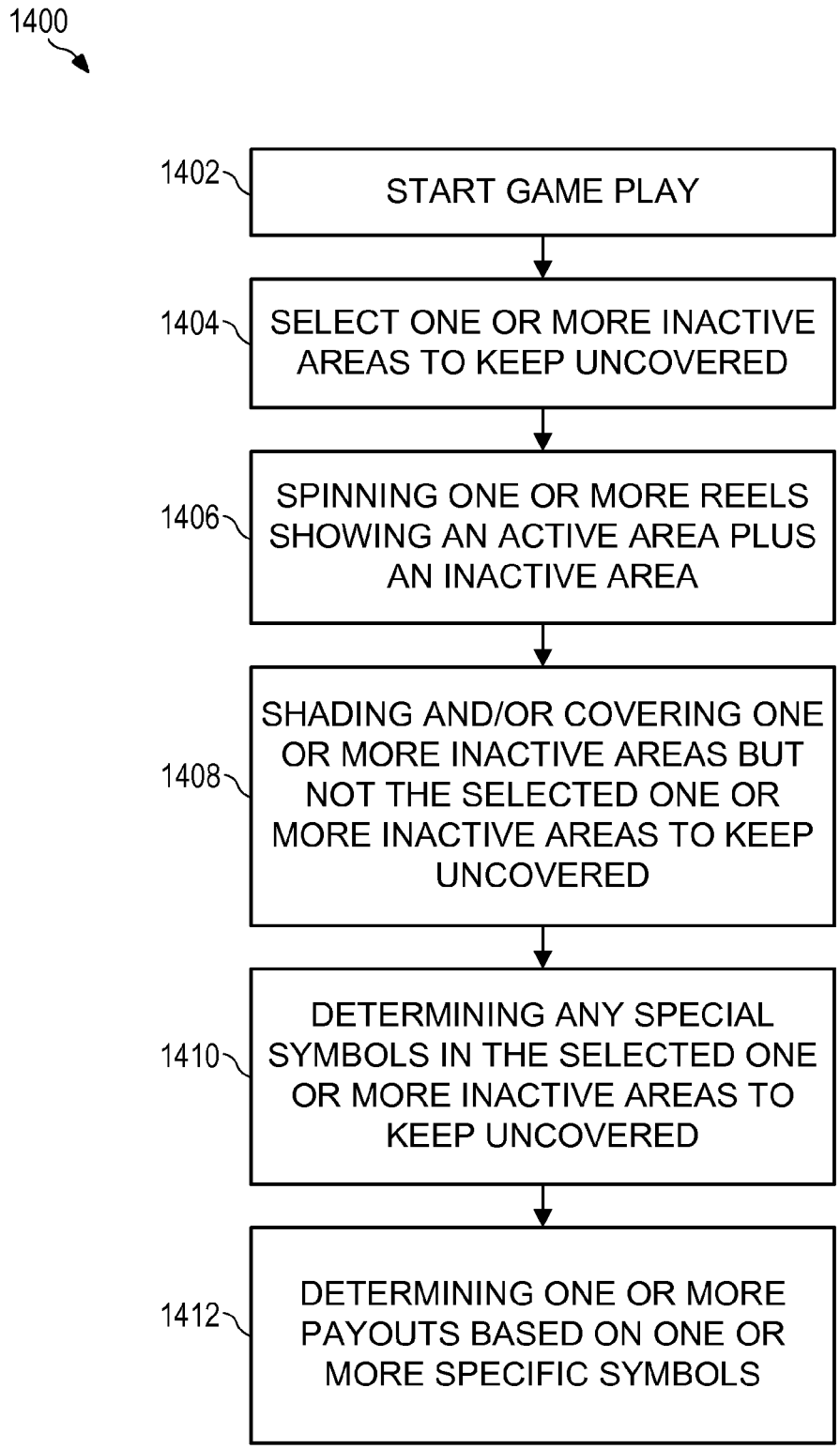
FIG. 14 is a flow diagram for game play, according to one embodiment.

In FIG. 14, a flow diagram for game play 1400 is shown, according to one embodiment. The method may include starting game play (step 1402). The method may include selecting one or more inactive areas to keep uncovered (step 1404). The method may include spinning one or more reels showing an active area plus an inactive area (step 1406). The method may include shading and/or covering one or more inactive areas but not the selected one or more inactive areas to keep these areas uncovered (step 1408). The method may include determining any special symbols in the selected one or more inactive areas to keep uncovered (step 1410). The method may include determining one or more payouts based on one or more specific symbols (step 1412).

A method may include one or more processors (e.g., via electronic gaming device 100 and/or electronic gaming system 200) determining whether the spin (e.g., current spin, last spin, etc.) is a collection spin. If the spin was not the collection spin, then the method may end. If the spin was the collection spin, then the method may determine one or more placements for the one or more collected symbols. The method may include placing and displaying one or more collected symbols. The method may include determining and displaying one or more payouts based on one or more collected symbol placements. In various examples discussed above, the triggering event may occur at any time (e.g., first spin, second spin, when a combination of symbols is achieved, the last spin, etc.).

Figure 15:
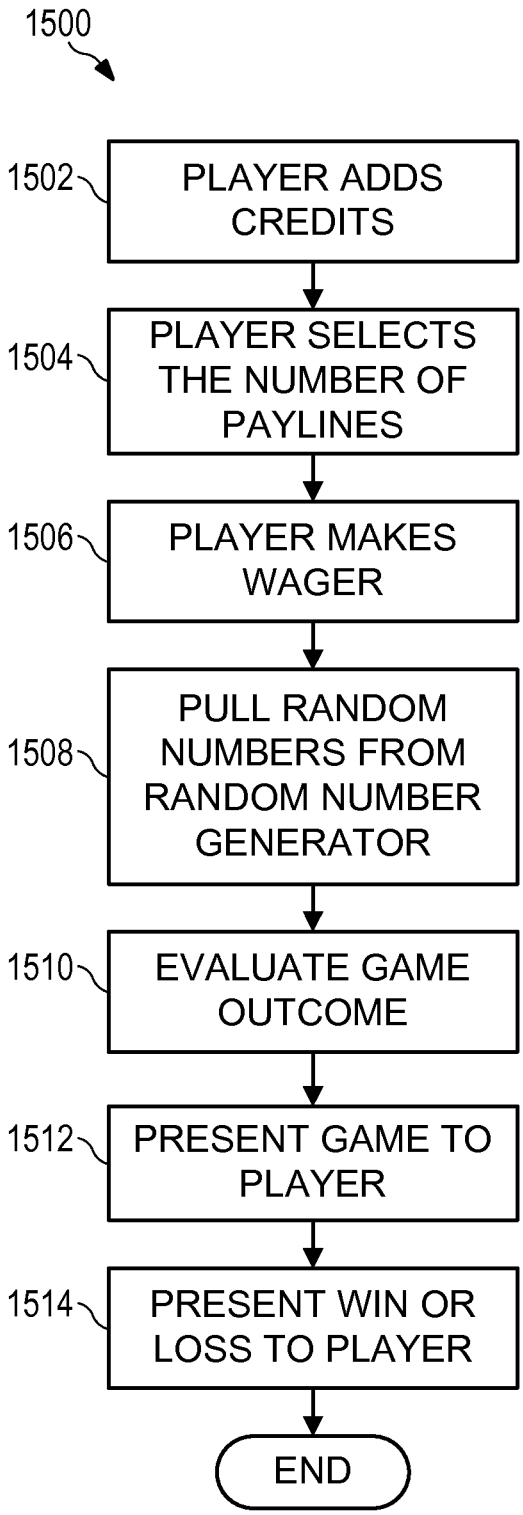
FIG. 15 is a flow diagram for game play, according to one embodiment.

In FIG. 15, a process flowchart of one example of a primary game play 1500 on an electronic gaming system is shown, according to one embodiment. The method may include the step of a player adding credit to the electronic gaming system (step 1502). It is contemplated that a player can do this by inserting cash, coins, a ticket representative of a cash value, a credit card, a player card, requesting an electronic funds transfer ("EFT"), otherwise requesting access to an account having monetary funds, and/or any combination thereof.

At step 1504, the player selects the number of paylines to play. In one embodiment, the player can select from a plurality of different paylines to play. In a further embodiment, the player can only play a predetermined number of paylines. An example of this embodiment may be the instance where the gaming system only allows a player to play forty paylines, and cannot select to play more or less paylines. In another embodiment, the gaming system does not offer paylines, but rather offers a different way to evaluate the game play. One example of a different way may be sometime referred to as a 243-ways evaluation, where symbols may be evaluated based on the existence of like-symbol clusters on adjacent reels, starting with the left-most reel and continuing right, instead of how many paylines run through the like-symbol clusters.

At step 1506, the player makes a wager on the game. In one embodiment, the wager may be a multiple of the number of paylines selected at step 1504. In another embodiment, the wager may not be a multiple of the number of paylines selected at step 1504. In a further embodiment, the wager may include a side-wager (e.g., ante bet), which may, in one example of such an embodiment, be used to make the player eligible to be awarded the extra functionality discussed above. It should be appreciated that in some embodiments, the order of steps 1504 and 1506 may be not critical, and so for example, a player can select the wager they wish to place, and then select the number of paylines they want it applied to, and that these embodiments are expressly contemplated as being within the scope of the present disclosure.

Continuing to step 1508, the gaming system pulls random numbers from a random number generator ("RNG"). In one embodiment, the system pulls one random number for each reel. In another embodiment, the system pulls one random number which may be utilized to determine the stop positions for each reel. In another embodiment, the random numbers determined by the RNG may be based on the time that the numbers may be pulled. In another embodiment, the random numbers determined by the RNG may be based on the prior numbers pulled.

At steps 1510 and 1512, the gaming system utilizes the random numbers pulled at step 1508 to determine the primary game symbols to display in the play of the primary game, which in turn both determines the presentation of the game to the player and evaluates the game outcome. In one embodiment, the random numbers pulled determine the stopping positions for the reels, which may be then caused to stop at those associated positions, and then the gaming system evaluates the displayed primary game symbols to determine the game outcome. In another embodiment, the gaming system determines the game outcome based on the pulled random numbers, and then causes the game to present an associated outcome to the player.

At step 1514, the win or loss outcome may be identified for the player. In one embodiment, this step can include additional messaging, which provides information related to the win or loss, such as why the player won or lost. In another embodiment, this step can include identification of the amount of any award earned by the player.

Figure 16:
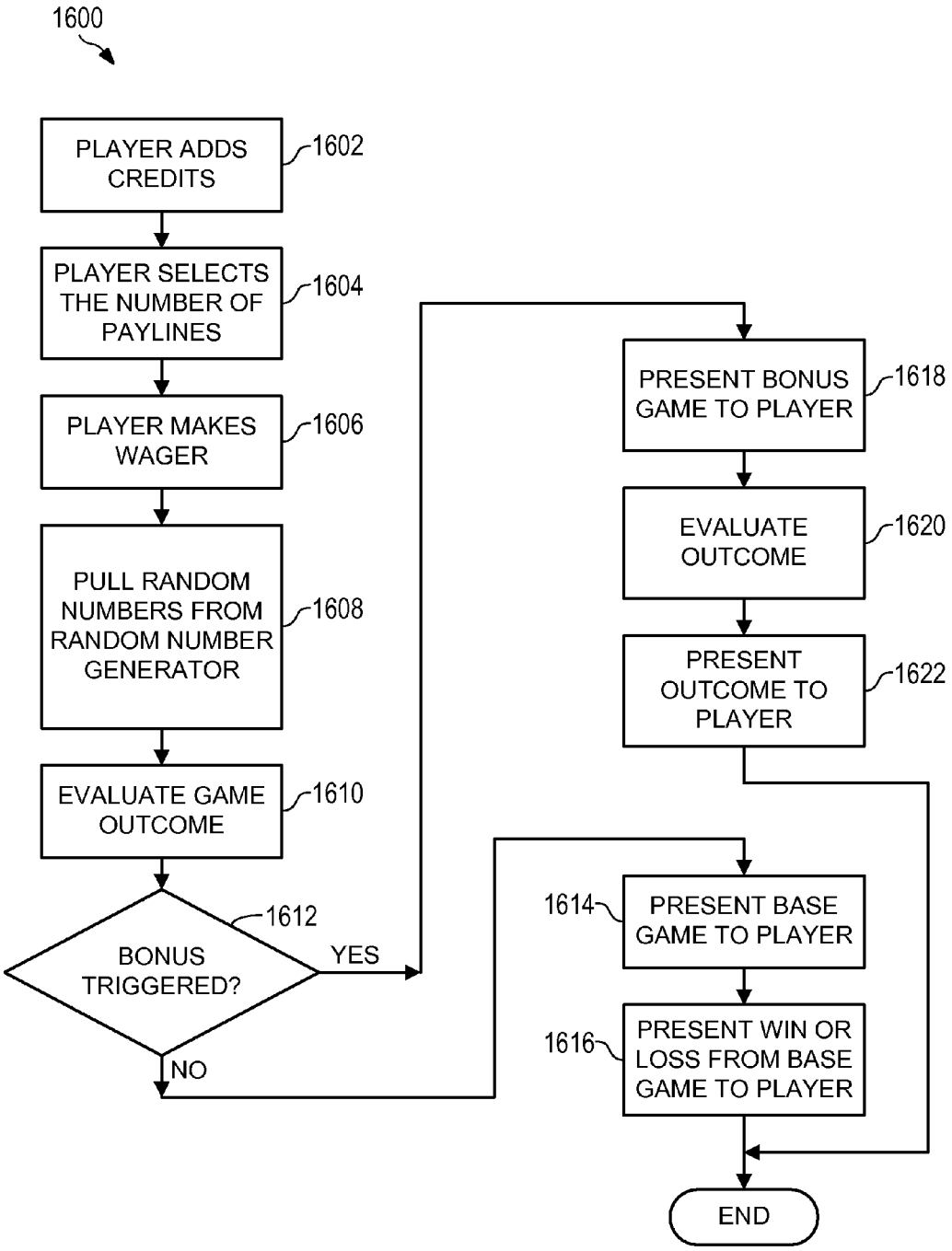
FIG. 16 is a flow diagram for game play, according to one embodiment.

FIG. 16 is a process flowchart of one example of a combined primary and secondary game play 1600 on an electronic gaming system, according to one embodiment. The method may include the step of a player adding credit to the electronic gaming system (step 1602). It is contemplated that a player can do this by inserting cash, coins, a ticket representative of a cash value, a credit card, a player card, requesting an electronic funds transfer ("EFT"), otherwise requesting access to an account having monetary funds, and/or any combination thereof.

At step 1604, the player selects the number of paylines to play. In one embodiment, the player can select from a plurality of different paylines to play. In a further embodiment, the player can only play a predetermined number of paylines. An example of this embodiment may be the instance where the gaming system only allows a player to play forty paylines, and cannot select to play more or less paylines. In another embodiment, the gaming system does not offer paylines, but rather offers a different way to evaluate the game play. One example of a different way may be sometime referred to as a 243-ways evaluation, where symbols may be evaluated based on the existence of like-symbol clusters on adjacent reels, starting with the left-most reel and continuing right, instead of how many paylines run through the like-symbol clusters.

At step 1606, the player makes a wager on the game. In one embodiment, the wager may be a multiple of the number of paylines selected at step 1604. In another embodiment, the wager may not be a multiple of the number of paylines selected at step 1604. In a further embodiment, the wager may include a side-wager, which may, in one example of such an embodiment, be used to make the player eligible to be awarded the extra functionality discussed above. It should be appreciated that in some embodiments, the order of steps 1604 and 1606 may be not critical, and so for example, a player can select the wager they wish to place, and then select the number of paylines they want it applied to, and that these embodiments may be expressly contemplated as being within the scope of the present disclosure.

Continuing to step 1608, the gaming system pulls random numbers from a random number generator "RNG". In one embodiment, the system pulls one random number for each reel. In another embodiment, the system pulls one random number which may be utilized to determine the stop positions for each reel. In another embodiment, the random numbers determined by the RNG may be based on the time that the numbers may be pulled. In another embodiment, the random numbers determined by the RNG may be based on the prior numbers pulled.

At step 1610, the gaming system utilizes the random numbers pulled at step 1608 to evaluate the game outcome. In one embodiment, the random numbers pulled determine the stopping positions for the reels, which may be then caused to stop at those associated positions, and then the gaming system evaluates the displayed primary game symbols to determine the game outcome. In another embodiment, the gaming system determines the game outcome based on the pulled random numbers, and then causes the game to present an associated outcome to the player.

At step 1612, the gaming system determines if a secondary or bonus game may be triggered. In one embodiment, the bonus game is triggered by the display of a plurality of matching symbols at a plurality of predetermined symbol positions within a play of the primary game. In one example, the bonus game may be triggered if a plurality of matching symbols is displayed on the $2^{nd}$, $3^{rd}$ and $4^{th}$ reel. In another example, the bonus game may be triggered if matching symbols are displayed on the $1^{st}$, $2^{nd}$ and $3^{rd}$ reels. In a further example, the bonus game may be triggered if matching symbols occur at predetermined symbol positions that include consecutive and non-consecutive reels. In another example, a bonus game (e.g., secondary game) may be triggered in any way (e.g., one special symbols in any locations, one special symbol in one or more predetermined locations, two special symbols in any locations, two special symbols in one or more predetermined locations, three special symbols in any locations, three special symbols in one or more predetermined locations, etc.).

If it is determined that a bonus or secondary game was not triggered, the process continues to step 1614, where the base game may be fully presented to the player. As discussed above, the orders of step 1610, 1612, and 1614 can be changed without affecting the novel concepts disclosed herein.

At step 1616, the win or loss outcome of the primary game may be identified for the player. In one embodiment, this step can include additional messaging, which provides information related to the win or loss, such as why the player won or lost. In another embodiment, this step can include identification of the amount of any award earned by the player If it is determined at step 1612 that a bonus or secondary game was triggered, then process 1600 continues to step 1618, where the secondary game may be presented to the player. As discussed above, there are numerous ways to present the secondary or bonus game to the player.

At steps 1620 and 1622, the outcome of the secondary game may be evaluated and presented to the player. In one embodiment, the outcome of the bonus game will always be a winning outcome. In another embodiment, the outcome of the secondary game will cause a significant award to be provided to the player. In one example of such an embodiment, the award may not be provided by the gaming system, as a casino operator may need to verify tax information before allowing such an award to be provided to the player. In one embodiment, instead of the process 1600 ending after step 1622, the process continues to step 1614 so as to finalize the primary game outcome presentation to the player.

One or more sensors may obtain and/or transmit one or more data points (e.g., positional data, temperature data, etc.) relating to one or more audio devices, one or more display devices, audio interface area, audio support area, audio locking device, one or more electrical attachment devices, one or more attachment areas, electronic gaming device 100, electronic gaming system 200, first audio device, wall of the audio installation area, back of the audio installation area, one or more audio interfaces, one or more electrical attachment points, an input area, one or more input devices, second audio device, front-mounted audio device, audio interface locked area, one or more electrical interconnection points, one or more electrical wires, one or more springs, one or more motors, one or more adjustable devices, and/or one or more sensors to one or more processors.

One or more sensors may obtain and/or transmit one or more data points (e.g., positional data, temperature data, etc.) relating to one or more audio devices, one or more display devices, one or more electrical wires, one or more springs, one or more motors, one or more adjustable devices, and/or one or more sensors to one or more processors.

In one embodiment, the electronic gaming device may include a plurality of reels. The one or more paylines may be formed on at least a portion of the plurality of reels. The electronic gaming device may include a memory.

In one embodiment, the electronic gaming device may include a plurality of reels. The plurality of reels may include one or more areas. The electronic gaming device may include a processor and a memory. The memory may include one or more reel exposing feature structures. The processor may generate one or more symbols to be located in the one or more areas. The processor may move a first reel exposed symbol to a first replacement location based on the first replacement location having a top award amount.

In another example, the processor may initiate a base game, a bonus game, and a reel exposing game. In one embodiment, an electronic gaming device may include a plurality of reels. The plurality of reels includes one or more areas. The electronic gaming device includes a memory. The memory may include one or more reel exposing feature structures. The gaming device may include a processor which may generate one or more symbols to be located in the one or more areas, display one or more symbols in a base game area before a start of game play, and/or display one or more revealed symbols in one or more revealed areas after the start of game play is initiated.

In another example, the one or more revealed symbols may be displayed outside of the base game area. In another example, the one or more revealed symbols may not be allowed to be utilized on a pay line. In one example, the one or more revealed symbols may be allowed to be utilized on a pay line. In an example, the one or more revealed symbols may be utilized as a replacement symbol. In addition, the processor may move the replacement symbol into the base game area. Further, a first portion of the one or more revealed symbols may not be allowed to be utilized on a pay line and a second portion of the one or more revealed symbols may be allowed to be utilized on the pay line. In another example, the one or more revealed symbols may include at least one special symbol. In addition, the special symbol may generate one or more prizes when the special symbol stops on at least one of the one or more revealed areas.

In another embodiment, the method of providing game play via an electronic gaming device may include: initiating via one or more processors a base game; initiating via the one or more processors a reel exposing game; displaying one or more symbols in a base game area before a start of game play; and/or displaying one or more revealed symbols in one or more revealed areas after the start of game play is initiated.

In another example, the one or more revealed symbols are displayed outside of the base game area. In another example, the one or more revealed symbols are not allowed to be utilized on a pay line. In another example, the one or more revealed symbols are allowed to be utilized on a pay line. In another example, the one or more revealed symbols are utilized as a replacement symbol. Further, the method may include moving the replacement symbol into the base game area.

In another embodiment, the electronic gaming system may include a server which includes a server processor and a server memory. The electronic gaming system may include a display device including a plurality of reels where the plurality of reels including one or more areas. The server memory may include one or more reel exposing feature structures. The server processor may generate one or more symbols to be located in the one or more areas, display one or more symbols in a base game area before a start of game play, and/or display one or more revealed symbols in one or more revealed areas after the start of game play is initiated.

In another example, the one or more revealed symbols may be displayed outside of the base game area. Further, the one or more revealed symbols may not be allowed to be utilized on a pay line. In addition, the one or more revealed symbols may be allowed to be utilized on a pay line. In an example, the one or more revealed symbols may be utilized as a replacement symbol.

In another example, during reel spins, a portion of the screen above (and/or below and/or the side and/or any other area) or the whole top screen may fade to reveal more of the reel strips. This may allow for the use of larger stacks and/or operations occurring on the reels for wild substitution. In another example, this may be a way of showing more of the reel for things like streaming stacks and wild substitution. During a reel spin, the top screen art (or any other area) above the reels fades to reveal more of the reel strips, so 4 or 5 more (and/or any other number and/or size) rows (and/or columns and/or any other area) may be visible. In addition, the art may fade back in when one or more reels stop.

In another example, the reel view activates momentarily during a spin to show a taller pre-view of the reels, and then shrinks the view again before the game is resolved. This may allow games to show off certain features of the reels, such as, how long a stack of symbols are on the stack, how a bonus symbol or large symbol may be coming (as a form of anticipation of a big win), a symbol substitution feature or similar game mechanic where the symbols on the reel may change during the pre-view, and/or any other reel characteristics.

In another example, during a spin in the base game, portions of the top screen fade (or any other area) to reveal a larger view of the reel strips, providing a preview of the symbols that will be appearing in the bottom screen (or any other area). In another example, the message may state that there are no additional paylines on the top screen. In this example, win calculations are only evaluated on the paylines and visible symbols that appear on the bottom screen.

In another example, a first payline may be activated on a non-base game area when specific areas are revealed (e.g., a first revealed row and a third revealed row or a second revealed row and a fourth revealed row). In another example, a second payline may be activated on a non-base game area when specific areas are revealed but other areas are not revealed (e.g., a first revealed row and a third revealed row but not a fifth revealed row).

Gaming system may be a "state-based" system. A state-based system stores and maintains the system's current state in a non-volatile memory. Therefore, if a power failure or other malfunction occurs, the gaming system will return to the gaming system's state before the power failure or other malfunction occurred when the gaming system is powered up.

State-based gaming systems may have various functions (e.g., wagering, payline selections, reel selections, game play, bonus game play, evaluation of game play, game play result, steps of graphical representations, etc.) of the game. Each function may define a state. Further, the gaming system may store game histories, which may be utilized to reconstruct previous game plays.

A state-based system is different than a Personal Computer ("PC") because a PC is not a state-based machine. A state-based system has different software and hardware design requirements as compared to a PC system.

The gaming system may include random number generators, authentication procedures, authentication keys, and operating system kernels. These devices, modules, software, and/or procedures may allow a gaming authority to track, verify, supervise, and manage the gaming system's codes and data.

A gaming system may include state-based software architecture, state-based supporting hardware, watchdog timers, voltage monitoring systems, trust memory, gaming system designed communication interfaces, and security monitoring.

For regulatory purposes, the gaming system may be designed to prevent the gaming system's owner from misusing (e.g., cheating) via the gaming system. The gaming system may be designed to be static and monolithic.

In one example, the instructions coded in the gaming system are non-changeable (e.g., static) and are approved by a gaming authority and installation of the codes are supervised by the gaming authority. Any change in the system may require approval from the gaming authority. Further, a gaming system may have a procedure/device to validate the code and prevent the code from being utilized if the code is invalid. The hardware and software configurations are designed to comply with the gaming authorities' requirements.

As used herein, the term "mobile device" refers to a device that may from time to time have a position that changes. Such changes in position may comprise of changes to direction, distance, and/or orientation. In particular examples, a mobile device may comprise of a cellular telephone, wireless communication device, user equipment, laptop computer, other personal communication system ("PCS") device, personal digital assistant ("PDA"), personal audio device ("PAD"), portable navigational device, or other portable communication device. A mobile device may also comprise of a processor or computing platform adapted to perform functions controlled by machine-readable instructions.

The methods and/or methodologies described herein may be implemented by various means depending upon applications according to particular examples. For example, such methodologies may be implemented in hardware, firmware, software, or combinations thereof. In a hardware implementation, for example, a processing unit may be implemented within one or more application specific integrated circuits ("ASICs"), digital signal processors ("DSPs"), digital signal processing devices ("DSPDs"), programmable logic devices ("PLDs"), field programmable gate arrays ("FPGAs"), processors, controllers, micro-controllers, microprocessors, electronic devices, other devices units designed to perform the functions described herein, or combinations thereof.

Some portions of the detailed description included herein are presented in terms of algorithms or symbolic representations of operations on binary digital signals stored within a memory of a specific apparatus or a special purpose computing device or platform. In the context of this particular specification, the term specific apparatus or the like includes a general purpose computer once it is programmed to perform particular operations pursuant to instructions from program software. Algorithmic descriptions or symbolic representations are examples of techniques used by those of ordinary skill in the arts to convey the substance of their work to others skilled in the art. An algorithm is considered to be a self-consistent sequence of operations or similar signal processing leading to a desired result. In this context, operations or processing involve physical manipulation of physical quantities. Typically, although not necessarily, such quantities may take the form of electrical or magnetic signals capable of being stored, transferred, combined, compared or otherwise manipulated. It has proven convenient at times, principally for reasons of common usage, to refer to such signals as bits, data, values, elements, symbols, characters, terms, numbers, numerals, or the like. It should be understood, however, that all of these or similar terms are to be associated with appropriate physical quantities and are merely convenient labels. Unless specifically stated otherwise, as apparent from the discussion herein, it is appreciated that throughout this specification discussions utilizing terms such as "processing," "computing," "calculating," "determining" or the like refer to actions or processes of a specific apparatus, such as a special purpose computer or a similar special purpose electronic computing device. In the context of this specification, therefore, a special purpose computer or a similar special purpose electronic computing device is capable of manipulating or transforming signals, typically represented as physical electronic or magnetic quantities within memories, registers, or other information storage devices, transmission devices, or display devices of the special purpose computer or similar special purpose electronic computing device.

Reference throughout this specification to "one example," "an example," "embodiment," and/or "another example" should be considered to mean that the particular features, structures, or characteristics may be combined in one or more examples.

While there has been illustrated and described what are presently considered to be example features, it will be understood by those skilled in the art that various other modifications may be made, and equivalents may be substituted, without departing from the disclosed subject matter. Additionally, many modifications may be made to adapt a particular situation to the teachings of the disclosed subject matter without departing from the central concept described herein. Therefore, it is intended that the disclosed subject matter not be limited to the particular examples disclosed. Further, one or more gaming options may be Internet based gaming options. Therefore, all of the examples and/or embodiments may be utilized via an Internet based gaming system.

The invention claimed is:

1. An electronic gaming device comprising:

a wager accepting device configured to accept a physical item associated with a monetary value to increase a credit balance maintained on the electronic gaming device;

a plurality of base game reels, the plurality of base game reels including a plurality of base game symbols;

a plurality of base game display areas displaying one or more of the base game symbols, at least one base game payline being defined through the base game display areas;

a memory, the memory including one or more reel exposing feature structures; and a processor configured to execute machine readable instructions stored on the memory which when executed, cause the gaming device to:

initiate a game by displaying the plurality of base game reels spinning to determine an outcome based on a final position of the base game symbols with respect to the at least one base game payline;

while at least one of the base game reels are spinning, display a revealed reel in addition to the plurality of base game reels, the revealed reel being displayed in a fading mode where the revealed reel is displayed fading in and out, the revealed reel comprising additional game symbols;

activate one or more bonus paylines being defined through the base game display areas and revealed reel display areas associated with the revealed reel according to a predetermined condition; and award a payout based on final positions of the base game symbols and the additional game symbols with respect to the at least one base game payline and the one or more bonus paylines, wherein the credit balance is updated based on the payout.

2. The electronic gaming device of claim 1, wherein the predetermined condition depends on one or more of the base game symbols of the base game reels.

3. The electronic gaming device of claim 1, wherein the predetermined condition depends on one or more of the additional game symbols of the revealed reel.

4. The electronic gaming device of claim 1, wherein the fading mode ends and the revealed reel remains revealed when the one or more bonus paylines is activated.

5. The electronic gaming device of claim 1, wherein one or more of the additional game symbols are utilized as a replacement symbol.

6. The electronic gaming device of claim 5, wherein the processor is further configured to move the replacement symbol onto one of the base game reels.

7. The electronic gaming device of claim 1, wherein the additional game symbols include at least one special symbol.

8. The electronic gaming device of claim 7, wherein the special symbol generates one or more prizes when the special symbol stops on at least one of the revealed reel display areas.

9. A method of providing game play via an electronic gaming device comprising:

receiving a physical item associated with a monetary value at a wager accepting device to increase a credit balance maintained on the electronic gaming device;

displaying base game symbols of a plurality of base game reels, the base game symbols being display at a plurality of base game display areas, at least one base game payline being defined through the plurality of base game display areas;

initiating a game by displaying the plurality of base game reels spinning to determine an outcome according to a final position of the base game symbols with respect to the at least one base game payline;

while at least one of the base game reels are spinning, displaying a revealed reel in addition to the plurality of base game reels, the revealed reel being displayed in a fading mode where the revealed reel is displayed fading in and out, the revealed reel comprising additional game symbols;

activating one or more bonus paylines being defined through the base game display areas and revealed reel display areas associated with the revealed reel according to a predetermined condition;

awarding a payout based on final positions of the base game symbols and the additional game symbols with respect to the at least one base game payline and the one or more bonus paylines; and updating the credit balance based on the payout.

10. The method of claim 9, wherein the predetermined condition depends on one or more of the base game symbols of the base game reels.

11. The method of claim 9, wherein the predetermined condition depends on one or more of the additional game symbols of the revealed reel.

12. The method of claim 9, wherein the fading mode ends and the revealed reel remains revealed when the one or more bonus paylines is activated.

13. The method of claim 9, wherein one or more of the additional game symbols are utilized as a replacement symbol.

14. The method of claim 13, wherein the replacement symbol is moved onto one of the base game reels.

15. The method of claim 9, wherein the additional game symbols include at least one special symbol.

16. The method of claim 9, wherein the special symbol generates one or more prizes when the special symbol stops on at least one of the revealed reel display areas.

17. An electronic gaming system comprising:

a wager accepting device configured to accept a physical item associated with a monetary value to increase a credit balance maintained on the electronic gaming system;

a server including a server processor and a server memory;

a display device configured to display base game symbols of a plurality of base game reels within a plurality of base game display, at least one base game payline being defined through the base game display areas;

the server memory including one or more reel exposing feature structures; and the server processor configured to execute machine readable instructions stored on the server memory which when executed, cause the electronic gaming system to:

initiate a game by displaying the plurality of base game reels spinning to determine an outcome based on a final position of the base game symbols with respect to the at least one base game payline;

while at least one of the base game reels are spinning, display a revealed reel in addition to the plurality of base game reels, the revealed reel being displayed in a fading mode where the revealed reel is displayed fading in and out, the revealed reel comprising additional game symbols;

activate one or more bonus paylines being defined through the base game display areas and revealed reel display areas associated with the revealed reel according to a predetermined condition; and award a payout based on final positions of the base game symbols and the additional game symbols with respect to the at least one base game payline and the one or more bonus paylines, wherein the credit balance is updated based on the payout.

18. The electronic gaming system of claim 17, wherein the predetermined condition depends on one or more of the base game symbols of the base game reels.

19. The electronic gaming system of claim 17, wherein the predetermined condition depends on one or more of the additional game symbols of the revealed reel.

20. The electronic gaming system of claim 17, wherein the fading mode ends and the revealed reel remains revealed when the one or more bonus paylines is activated.

* * * * *